US011511541B2

(12) United States Patent
Shinomiya et al.

(10) Patent No.: US 11,511,541 B2
(45) Date of Patent: Nov. 29, 2022

(54) INKJET HEAD CLEANING UNIT AND CLEANING SYSTEM

(71) Applicant: Roland DG Corporation, Hamamatsu (JP)

(72) Inventors: Bunji Shinomiya, Hamamatsu (JP); Shunsuke Kawai, Hamamatsu (JP); Takayoshi Oguri, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 17/263,610

(22) PCT Filed: Jul. 23, 2019

(86) PCT No.: PCT/JP2019/028889

§ 371 (c)(1),
(2) Date: Jan. 27, 2021

(87) PCT Pub. No.: WO2020/026897

PCT Pub. Date: Feb. 6, 2020

(65) Prior Publication Data

US 2021/0291530 A1 Sep. 23, 2021

(30) Foreign Application Priority Data

Jul. 31, 2018 (JP) ..... JP2018-144552
Nov. 30, 2018 (JP) ..... JP2018-225567

(51) Int. Cl.
*B41J 2/165* (2006.01)

(52) U.S. Cl.
CPC ..... *B41J 2/16517* (2013.01)

(58) Field of Classification Search
CPC ..... B41J 2/16517; B41J 2/16508
See application file for complete search history.

(56) References Cited

U.S. PATENT DOCUMENTS

| | | | | |
|---|---|---|---|---|
| 10,322,585 | B2 * | 6/2019 | Okuno | B41J 2/165 |
| 2007/0134969 | A1 | 6/2007 | Endo et al. | |
| 2008/0094440 | A1 | 4/2008 | Kamiyama | |
| 2012/0218346 | A1 | 8/2012 | Inoue | |
| 2016/0144626 | A1 | 5/2016 | Nakagawa et al. | |
| 2017/0015101 | A1 | 1/2017 | Coma Vives et al. | |

(Continued)

FOREIGN PATENT DOCUMENTS

| | | | |
|---|---|---|---|
| JP | 07-125228 | A | 5/1995 |
| JP | 2007-176152 | A | 7/2007 |

(Continued)

OTHER PUBLICATIONS

Official Communication issued in International Patent Application No. PCT/JP2019/028889, dated Sep. 10, 2019.

(Continued)

*Primary Examiner* — Sharon Polk
(74) *Attorney, Agent, or Firm* — Keating & Bennett, LLP

(57) ABSTRACT

An inkjet printer cleaning system includes an inkjet printer and a cleaning unit. The inkjet printer includes an ink head and a table that faces the ink head and on which a substrate is to be placed. The cleaning unit includes an attachment attachable to and removable from the table, and a cleaner that faces the ink head upon attaching of the attachment to the table.

18 Claims, 19 Drawing Sheets

(56) References Cited

U.S. PATENT DOCUMENTS

| | | | | |
|---|---|---|---|---|
| 2017/0113463 | A1 | 4/2017 | Harada et al. | |
| 2019/0039378 | A1 * | 2/2019 | Okuno | B41J 2/165 |
| 2020/0039230 | A1 * | 2/2020 | Shinomiya | B41J 2/16544 |

FOREIGN PATENT DOCUMENTS

| | | | | |
|---|---|---|---|---|
| JP | 2008-104916 | A | 5/2008 | |
| JP | 2009-137210 | A | 6/2009 | |
| JP | 2011-161845 | A | 8/2011 | |
| JP | 2012-171345 | A | 9/2012 | |
| JP | 2016-097597 | A | 5/2016 | |
| JP | 2017-077699 | A | 4/2017 | |
| JP | 2017-193159 | A | 10/2017 | |
| WO | WO-2018174875 | A1 * | 9/2018 | B41J 2/16508 |

OTHER PUBLICATIONS

Okuno et al., "Inkjet Printer", U.S. Appl. No. 16/051,754, filed Aug. 1, 2018.

* cited by examiner

INKJET HEAD CLEANING UNIT AND CLEANING SYSTEM

BACKGROUND OF THE INVENTION

1. Field of the Invention

The present invention relates to inkjet head cleaning units and cleaning systems.

2. Description of the Related Art

Inkjet printers known in the related art include wiping devices to remove fluids, such as ink, adhering to ink heads. JP H07-125228 A, for example, discloses an inkjet recording apparatus including a wiper (or blade) that comes into sliding contact with discharge port surfaces of a plurality of recording heads so as to wipe off a fluid, such as ink.

Surfaces of ink heads in which nozzles are defined may be provided with, for example, nozzle protectors, such as head guards. When convex portions of the nozzle protectors, such as head guards, are provided on the surfaces in which the nozzles are defined, the convex portions may get in the way, making it impossible for a wiper to clean the nozzles successfully. In addition, the cleaner may fail to come into close contact with the nozzles depending on the shapes of the ink heads. This may result in unsatisfactory head cleaning quality.

SUMMARY OF THE INVENTION

Preferred embodiments of the present invention provide inkjet head cleaning units that are each able to improve head cleaning quality. Preferred embodiments of the present invention also provide cleaning systems that each include such cleaning units.

According to a preferred embodiment of the present invention, an inkjet printer cleaning system includes an inkjet printer and a cleaning unit. The inkjet printer includes an ink head and a table that faces the ink head and on which a substrate is to be placed. The cleaning unit includes an attachment attachable to and removable from the table, and a cleaner that faces the ink head upon attaching of the attachment to the table.

The cleaning unit performs cleaning, with the flexible convex surface facing the ink head. Thus, the degree of close contact of the cleaner with nozzles will be higher than when the cleaner includes a flat upper end, for example. Accordingly, the cleaning unit is able to improve head cleaning quality.

The above and other elements, features, steps, characteristics, and advantages of the present invention will become more apparent from the following detailed description of the preferred embodiments with reference to the attached drawings.

DETAILED DESCRIPTION OF THE PREFERRED EMBODIMENTS

Figure 1:
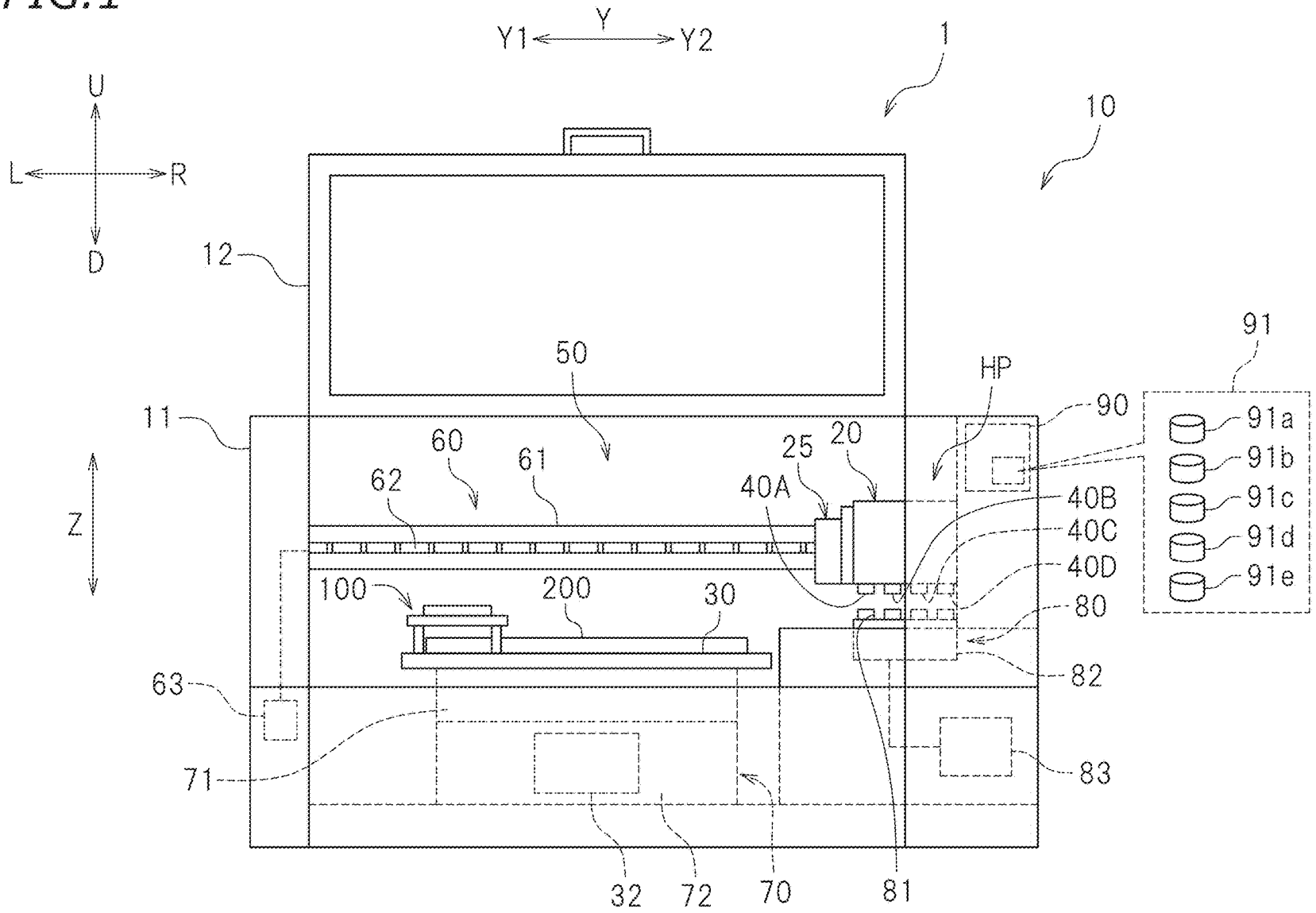
FIG. 1 is a front view of a printer according to a preferred embodiment of the present invention.

Inkjet printer cleaning systems according to preferred embodiments of the present invention will be described below with reference to the drawings. The preferred embodiments described below are naturally not intended to limit the present invention in any way. Components or elements having the same or similar features are identified by the same reference signs, and description thereof will be simplified or omitted when deemed redundant. In the following description, when an inkjet printer is viewed from the front, a direction away from the inkjet printer is a forward direction, and a direction toward the inkjet printer is a rearward direction. The reference signs F, Rr, L, R, U, and D in the drawings respectively represent front, rear, left, right, up, and down. These directions, however, are defined merely for the sake of convenience of description and do not limit, for example, how the inkjet printer may be installed.

The reference sign Y in the drawings represents a main scanning direction. The main scanning direction Y is a right-left direction. The main scanning direction Y includes two main scanning directions. One of the main scanning directions will hereinafter be referred to as a "first main scanning direction Y1" as appropriate, and the other one of the main scanning directions will hereinafter be referred to as a "second main scanning direction Y2" as appropriate. In the present preferred embodiment, the first main scanning direction Y1 is a leftward direction, and the second main scanning direction Y2 is a rightward direction. The reference sign X represents a sub-scanning direction. The sub-scanning direction X is a front-rear direction. The main scanning direction Y and the sub-scanning direction X are perpendicular to each other in a plan view. The sub-scanning direction X includes two sub-scanning directions. One of the sub-scanning directions will hereinafter be referred to as a "first sub-scanning direction X1" as appropriate, and the other one of the sub-scanning directions will hereinafter be referred to as a "second sub-scanning direction X2" as appropriate. In the present preferred embodiment, the first sub-scanning direction X1 is a forward direction, and the second sub-scanning direction X2 is a rearward direction. The reference sign Z represents an up-down direction. The up-down direction Z is perpendicular to the main scanning direction Y and the sub-scanning direction X. The main scanning direction Y, the sub-scanning direction X, and the up-down direction Z, however, are not limited to any particular directions but may be set to any suitable directions in accordance with the type of a printer 10.

As illustrated in FIG. 1, a cleaning system 1 according to the present preferred embodiment includes the printer 10 and a cleaning unit 100. The cleaning system 1 is a system to clean ink heads 40A to 40D of the printer 10 using the cleaning unit 100. The cleaning unit 100 is attachable to and detachable from a table 30. In this preferred embodiment, the cleaning unit 100 and the printer 10 define the cleaning system 1. The cleaning unit 100, however, may be a detachable component of the printer 10.

The printer 10 includes a printer body 11, a carriage 20, the ink heads 40A to 40D mounted on the carriage 20, a conveyor 50, a capper 80, and a control device 90.

The printer body 11 has a box shape whose front is open. The printer body 11 extends in the right-left direction. The carriage 20, the table 30, the ink heads 40A to 40D, the conveyor 50, the capper 80, and the control device 90 are housed in the printer body 11. The printer body 11 includes a front cover 12 that is able to open and close the front opening of the printer body 11.

As illustrated in FIG. 1, the table 30 is located substantially centrally in the main scanning direction Y in the internal space of the printer body 11. The table 30 is installed substantially horizontally. The table 30 is a component on which a substrate 5 (see FIG. 2) is to be placed. The printer 10 according to the present preferred embodiment is a "flatbed type" printer.

Figure 2:
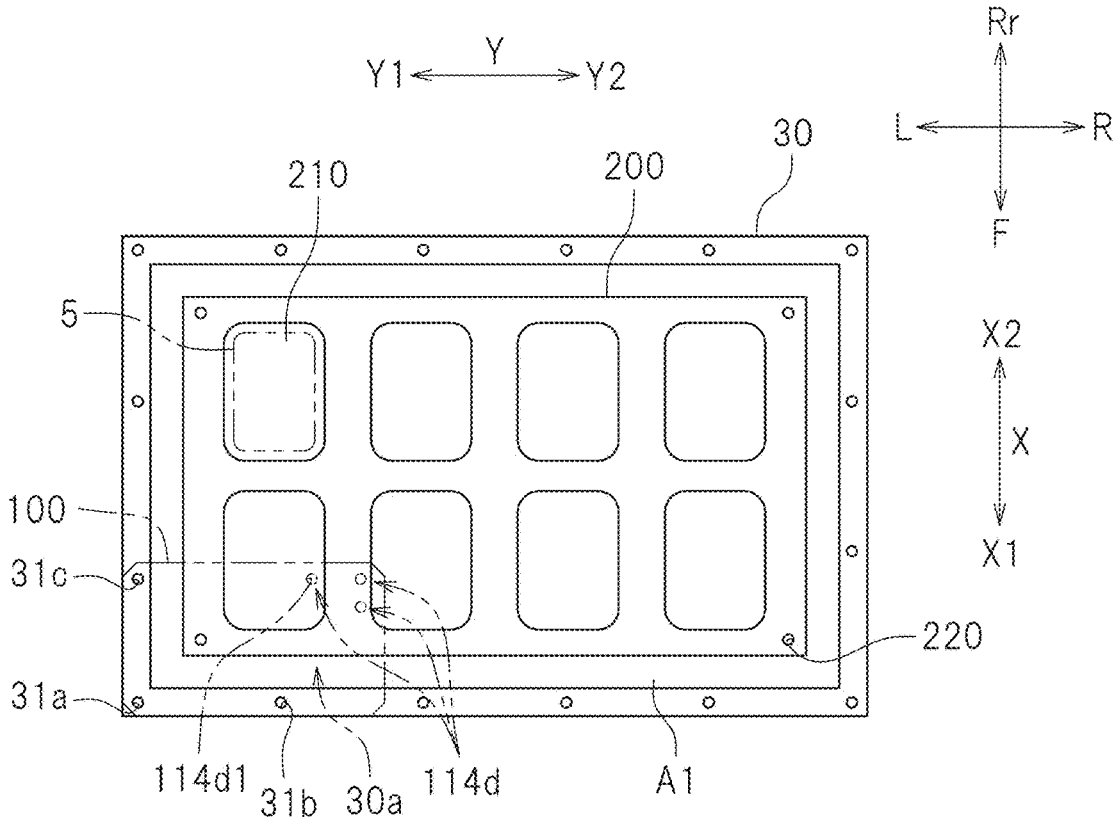
FIG. 2 is a plan view of a table.

FIG. 2 is a plan view of the table 30. In FIG. 2, the cleaning unit 100 is identified by the chain double-dashed line. As illustrated in FIG. 2, a jig 200 to position the substrate 5 is placed on the table 30. The shape of the substrate 5 is not limited to any particular shape. The substrate 5 may have not only a flat plate shape but also any of various three-dimensional shapes. A material for the substrate 5 is not limited to any particular material. The substrate 5 may include, for example, wood, metal, glass, paper, or fabric. As illustrated in FIG. 2, printing may be effected on more than one substrate 5. The substrates 5 are each fitted into a corresponding one of holders 210 of the jig 200. In this preferred embodiment, each holder 210 is a planar through hole conforming to the corresponding substrate 5. The substrates 5 are fitted into the holders 210 and thus positioned with respect to the table 30. The jig 200 has a constant or substantially constant thickness. A material of a standardized thickness is preferably provided for the jig 200, for example. The jig 200 has a thickness of, for example, about 3 mm or about 6 mm. The jig 200 includes, for example, a resin, such as an ABS resin.

As illustrated in FIG. 2, a printing area A1 is defined on the table 30. The printing area A1 is a maximum printable region. In this preferred embodiment, the jig 200 is located inside the printing area A1. Although not illustrated, the printing area A1 of the table 30 is provided with a plurality of threaded holes. Using the threaded holes, the jig 200 is secured to the table 30 with bolts 220. Although not illustrated, the table 30 is provided with a plurality of through holes. As illustrated in FIG. 1, a fan 32 is installed under the table 30. Driving the fan 32 discharges air from a space under the table 30, thus generating a negative pressure in the space under the table 30. With this negative pressure, the substrates 5 are sucked to the table 30 through the through holes.

As illustrated in FIG. 2, the table 30 includes a cleaning unit installation portion 30*a* on which the cleaning unit 100 is to be installed. In this preferred embodiment, the cleaning unit installation portion 30*a* extends from the left front end of the table 30 over a predetermined range. The cleaning unit installation portion 30*a* includes fitting holes 31*a* to 31*c* into which legs 141 to 143 (see FIG. 4A) of the cleaning unit 100 are to be inserted respectively. The fitting holes 31*a* to 31*c* define a first positioner to determine a position where the cleaning unit 100 is to be fitted to the cleaning unit installation portion 30*a*. The fitting holes 31*a* to 31*c* are through holes passing through the table 30 in the up-down direction Z. The fitting holes 31*a* to 31*c* are located outside the printing area A1 of the table 30. Specifically, the first fitting hole 31*a* is provided on the left front end of the table 30. The second fitting hole 31*b* is provided on the front end of the table 30 and located rightward of the first fitting hole 31*a*. The third fitting hole 31*c* is provided on the left end of the table 30 and located behind the first fitting hole 31*a*. Although the number of fitting holes provided in the cleaning unit installation portion 30*a* is three in the present preferred embodiment, the cleaning unit installation portion 30*a* only requires at least two fitting holes. The at least two fitting holes are able to define and function as the positioner.

Figure 3:
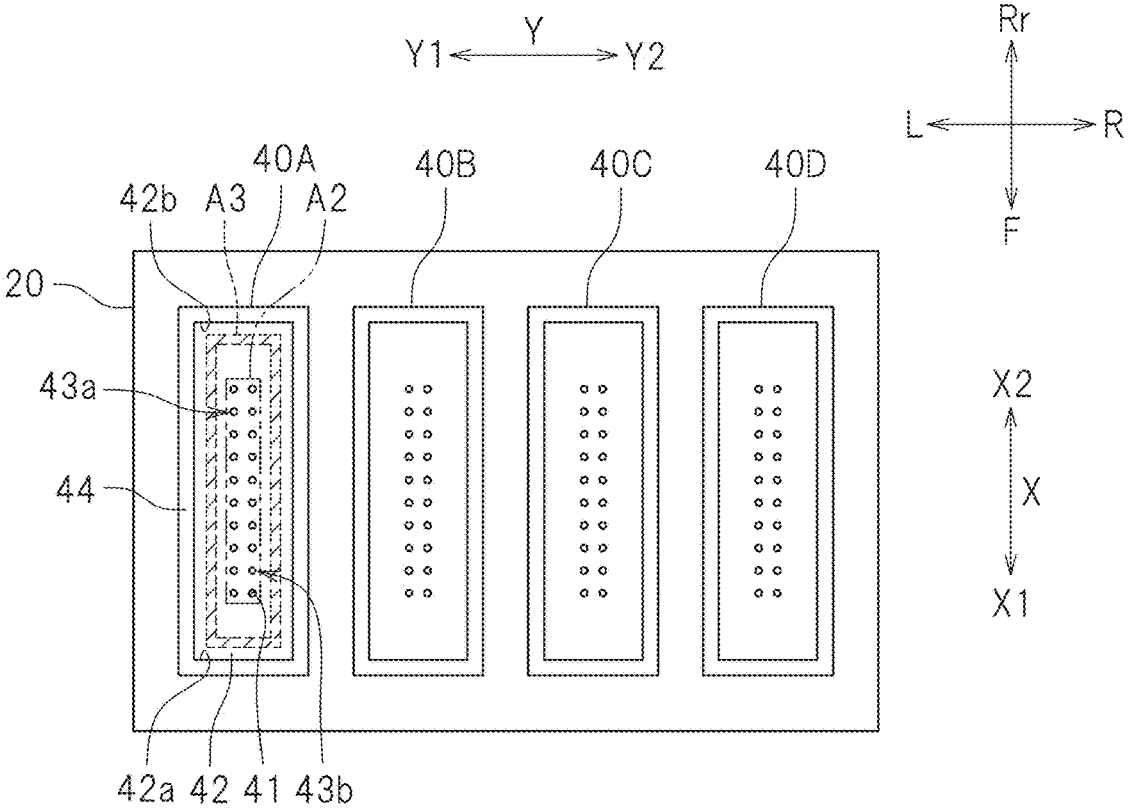
FIG. 3 is a plan view of the lower surface of a carriage.

The ink heads 40A to 40D face the table 30. The ink heads 40A to 40D are mounted on the carriage 20. The carriage 20 is in movable engagement with the printer body 11 through a guide rail 61 of the conveyor 50. FIG. 3 is a plan view of the lower surface of the carriage 20. As illustrated in FIG. 3, the ink heads 40A to 40D are located side by side on the carriage 20 in the main scanning direction Y. The first ink head 40A is located outermost in the first main scanning direction Y1 (which is the leftward direction in this preferred embodiment). The second ink head 40B is provided in the second main scanning direction Y2 (which is the rightward direction in this preferred embodiment) relative to the first ink head 40A. The third ink head 40C is provided in the second main scanning direction Y2 relative to the second ink head 40B. The fourth ink head 40D is located outermost in the second main scanning direction Y2. The ink heads 40A to 40D each extend in the sub-scanning direction X. The ink heads 40A to 40D are identical in position in the sub-scanning direction X.

The first ink head 40A includes a nozzle surface 42 provided with a plurality of nozzles 41. In this preferred embodiment, the nozzle surface 42 is the lower surface of the first ink head 40A. The nozzles 41 are minute holes to discharge ink. The nozzles 41 are each connected with an actuator including a piezoelectric element. Driving each actuator causes the corresponding nozzle 41 to discharge ink. Each actuator includes: a pressure chamber which is in communication with the corresponding nozzle 41 and in which ink is stored; and the piezoelectric element in contact with the pressure chamber. Changing a voltage to be applied to the piezoelectric element causes the piezoelectric element to expand or contract. The resulting displacement changes the volume of the pressure chamber. The change in the volume of the pressure chamber discharges ink from the nozzle 41. The actuators are electrically connected to the control device 90 and controlled by the control device 90. The nozzles 41 of the first ink head 40A define two nozzle rows (i.e., nozzle rows 43*a* and 43*b*) extending in the sub-scanning direction X. The first nozzle row 43*a* and the second nozzle row 43*b* are located side by side in the main scanning direction Y.

The nozzle surface 42 of the first ink head 40A is provided with a nozzle forming region A2 including all of the nozzles 41. In this preferred embodiment, the nozzle forming region A2 is a rectangular or substantially rectangular region whose boundary is located outward of the first nozzle row 43*a* and the second nozzle row 43*b* as illustrated in FIG. 3. The nozzle forming region A2 is a virtual region that defines an area of the nozzle surface 42 where the nozzles 41 are provided and the outer edge of the area. The nozzle forming region A2 does not necessarily have to include any particular element other than the nozzles 41. As illustrated in FIG. 3, a region A3 that comes into contact with a corresponding one of caps 81 (which will be described below) is located outward of the nozzle forming region A2.

The nozzle surface 42 includes an end 42*a* located in the first sub-scanning direction X1 (which may hereinafter be referred to as a "first end 42*a*"), and an end 42*b* located in the second sub-scanning direction X2 (which may hereinafter be referred to as a "second end 42*b*"). In this preferred embodiment, the first end 42*a* is the front end of the nozzle surface 42, and the second end 42*b* is the rear end of the nozzle surface 42. A head guard 44 is provided outward of the nozzle surface 42 whose boundary includes the first end 42*a* and the second end 42*b*. The head guard 44 protrudes below the nozzle surface 42. The head guard 44 is provided in order to prevent an obstacle from colliding with the nozzles 41. The boundary between the head guard 44 and the nozzle surface 42 defines a step.

The second to fourth ink heads 40B to 40D each have the same or similar structure as the first ink head 40A. The nozzle rows of the ink heads 40A to 40D are each connected with a single ink cartridge (not illustrated). The nozzle rows of the ink heads 40A to 40D discharge ink stored in the ink cartridges connected thereto. A material for the ink is not limited to any particular material. Any of various materials, which have conventionally been used as ink materials for inkjet printers, is usable. In this preferred embodiment, UV-curable pigment ink that cures upon receiving ultraviolet light is used.

As illustrated in FIG. 1, the carriage 20 is provided with an ultraviolet lamp 25. In this preferred embodiment, the ultraviolet lamp 25 is provided on the left lateral surface of the carriage 20. The ultraviolet lamp 25 extends in the sub-scanning direction X. The ultraviolet lamp 25 applies ultraviolet light toward the table 30. The ultraviolet lamp 25 is electrically connected to the control device 90 and controlled by the control device 90.

The conveyor 50 is a device to move the ink heads 40A to 40D relative to the table 30. The conveyor 50 according to the present preferred embodiment includes a carriage conveying device 60 and a table conveying device 70. The carriage conveying device 60 moves the carriage 20 in the main scanning direction Y. The main scanning direction Y is parallel to the table 30. The carriage conveying device 60 includes the guide rail 61, a belt 62, right and left pulleys (not illustrated), and a scan motor 63. The carriage 20 is in slidable engagement with the guide rail 61. The guide rail 61 is secured to the printer body 11. The guide rail 61 extends in the right-left direction. The guide rail 61 guides movement of the carriage 20 in the right-left direction. The belt 62 is secured to the carriage 20. The belt 62 is an endless belt. The belt 62 is wound around the right and left pulleys (not illustrated) provided on the guide rail 61. One of the pulleys is connected with the scan motor 63. The scan motor 63 is electrically connected to the control device 90. The scan motor 63 is controlled by the control device 90. Driving the scan motor 63 rotates the pulleys, causing the belt 62 to run. This moves the carriage 20 along the guide rail 61 in the right-left direction.

The table conveying device 70 is located under the table 30. The table conveying device 70 is a device to move the table 30 in the sub-scanning direction X and the up-down direction Z. The table conveying device 70 supports the table 30 from below. The table conveying device 70 includes a Z-axis conveying unit 71 and an X-axis conveying unit 72. The Z-axis conveying unit 71 moves the table 30 in the up-down direction Z while supporting the table 30. The up-down direction Z is orthogonal to the table 30. The Z-axis conveying unit 71 includes a ball screw mechanism (not illustrated) and a motor (not illustrated). The ball screw mechanism is driven by the motor. The Z-axis conveying unit 71 is supported by the X-axis conveying unit 72 from below. The X-axis conveying unit 72 moves the table 30 in the sub-scanning direction X. The sub-scanning direction X is parallel to the table 30 and perpendicular to the main scanning direction Y. The X-axis conveying unit 72 includes a ball screw mechanism (not illustrated) and a motor (not illustrated).

The conveyor 50 is not limited to any particular configuration or structure. The conveyor 50 preferably includes a conveying device to move at least either the ink heads 40A to 40D or the table 30 in the main scanning direction Y; a conveying device to move at least either the ink heads 40A to 40D or the table 30 in the sub-scanning direction X; and a conveying device to move at least either the ink heads 40A to 40D or the table 30 in the up-down direction Z. No further limitations are imposed on the configuration or structure of the conveyor 50. In one example, the conveyor may move one of the table 30 and the carriage 20 in the main scanning direction Y, the sub-scanning direction X, and the up-down direction Z. In another example, the conveyor may move both of the table 30 and the carriage 20 in the main scanning direction Y, the sub-scanning direction X, and the up-down direction Z. As long as the ink heads 40A to 40D and the table 30 move relative to each other, any of the components may be moved in any direction. The conveyor 50 is electrically connected to the control device 90 and controlled by the control device 90.

As illustrated in FIG. 1, a home position HP is set on the right end of the movable range of the carriage 20. The home position HP is a position at which the carriage 20 is located during printing standby, for example. The capper 80 is located under the carriage 20 located at the home position HP. The capper 80 includes the caps 81, a cap conveyor 82, and a suction pump 83.

The number of caps 81 provided is equal to the number of ink heads 40A to 40D. Each of the ink heads corresponds to one of the caps 81. Each cap 81 has a shape similar to a container with an upper surface provided with an opening. Each cap 81 includes, for example, rubber. The upper edges of the caps 81 conform to the regions A3 illustrated in FIG. 3, with which the caps 81 are to come into contact. Upon attaching of the caps 81 to the ink heads 40A to 40D, the upper edges of the caps 81 come into contact with the regions A3 located outward of the nozzle forming regions A2.

The caps 81 are supported by the single cap conveyor 82. The cap conveyor 82 moves the caps 81 into contact with or away from the nozzle surfaces 42 of the ink heads 40A to 40D. The cap conveyor 82 moves the caps 81 in the up-down direction Z while supporting the caps 81 from below. The caps 81 are thus fitted to the ink heads 40A to 40D or moved away from the ink heads 40A to 40D. Upon attaching of the caps 81 to the ink heads 40A to 40D, the upper edges of the caps 81 are pressed against the nozzle surfaces 42. The caps 81 are thus brought into close contact with the nozzle surfaces 42 with the elasticity of the caps 81.

The suction pump 83 is connected to the caps 81 through, for example, tubes (not illustrated). The suction pump 83 sucks fluids (for example, ink) stored in the caps 81. The suction pump is electrically connected to the control device 90 and controlled by the control device 90.

As illustrated in FIG. 1, the control device 90 to control various operations of the printer 10 is housed in the right end of the printer 10. As illustrated in FIG. 1, the control device 90 includes a cleaning controller 91. The cleaning controller 91 controls the conveyor 50 to bring cleaners 120A to 120H of the cleaning unit 100 into contact with the ink heads 40A to 40D. The cleaning controller 91 causes the ink heads 40A to 40D and the cleaning unit 100 to move with predetermined motions, thus cleaning the ink heads 40A to 40D. Although the control device 90 further includes controller(s) that control other operations, for example, printing, description thereof will be omitted. The cleaning controller 91 includes a first controller 91*a*, a second controller 91*b*, a third controller 91*c*, a fourth controller 91*d*, and a fifth controller 91*e*.

The control device 90 is not limited to any particular features or structure. The control device 90 is, for example, a microcomputer. The hardware implementation of the microcomputer is not particularly limited. In one example, the microcomputer includes: an interface (I/F) to receive, for example, print data from an external device, such as a host computer; a central processing unit (CPU) to execute commands included in a control program; a read-only memory (ROM) storing the program to be executed by the CPU; a random-access memory (RAM) used as a working area where the program is to be decompressed; and a storage device (for example, a memory) storing the program and various data.

The first controller 91*a* of the cleaning controller 91 performs a first step of a cleaning operation. The first step involves bringing the cleaners 120A to 120H into contact with portions of the nozzle surfaces 42 located in the second sub-scanning direction X2 relative to the first ends 42*a*. After the first step, the second controller 91*b* performs a second step. The second step involves moving the cleaners 120A to 120H relative to the ink heads 40A to 40D in the second sub-scanning direction X2 while keeping the cleaners 120A to 120H in contact with the nozzle surfaces 42. After the second step, the third controller 91*c* performs a third step. The third step involves moving the cleaners 120A to 120H away from the nozzle surfaces 42. After the third step, the fourth controller 91*d* performs a fourth step. The fourth step involves bringing the cleaners 120A to 120H into contact with portions of the nozzle surfaces 42 located in the first sub-scanning direction X1 relative to the second ends 42*b*. After the fourth step, the fifth controller 91*e* performs a fifth step. The fifth step involves moving the cleaners 120A to 120H relative to the ink heads 40A to 40D in the first sub-scanning direction X1 while keeping the cleaners 120A to 120H in contact with the nozzle surfaces 42. The cleaning operation will be described below in more detail.

Figure 4A:
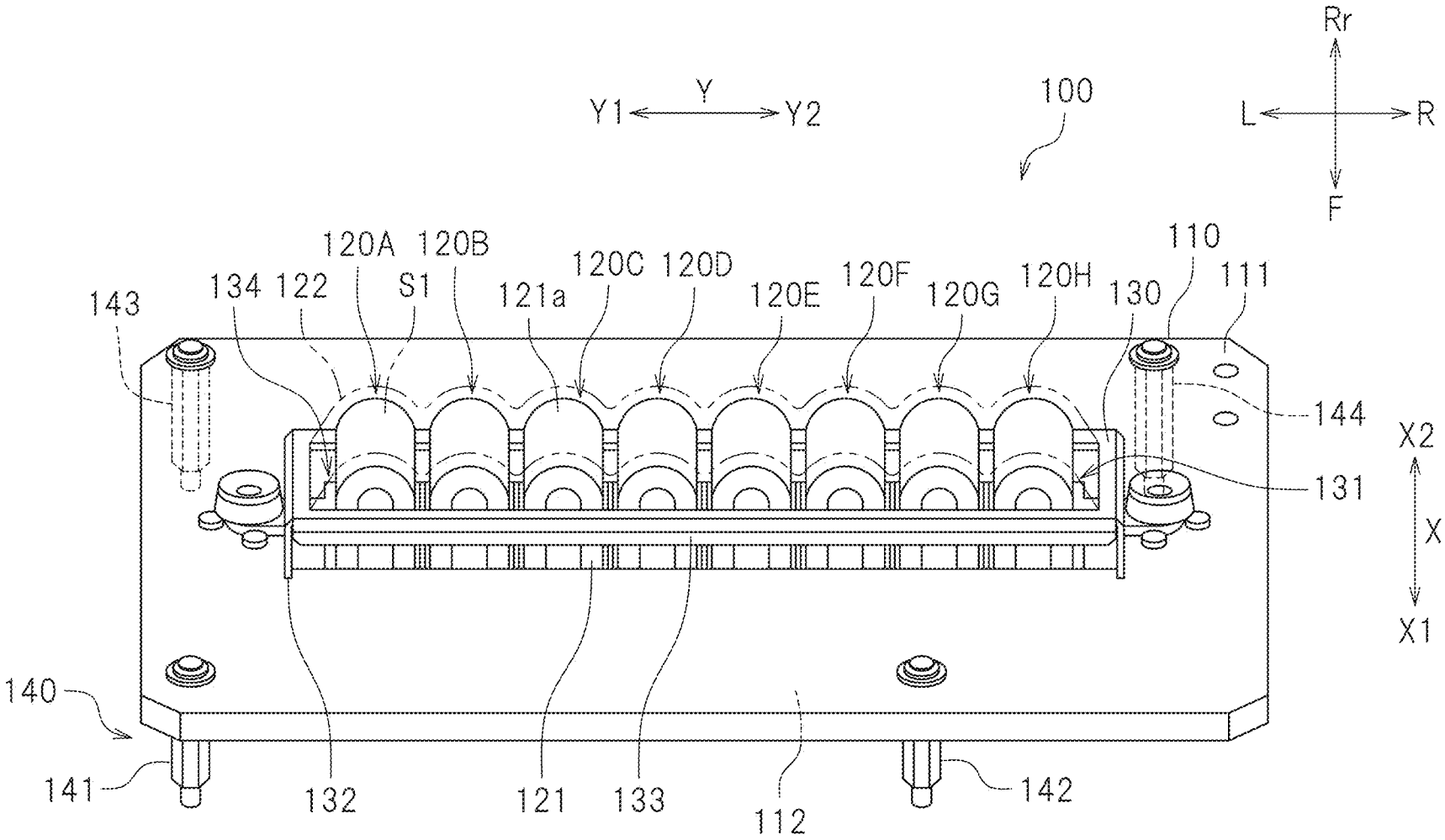
FIG. 4A is a perspective view of a cleaning unit.
Figure 4B:
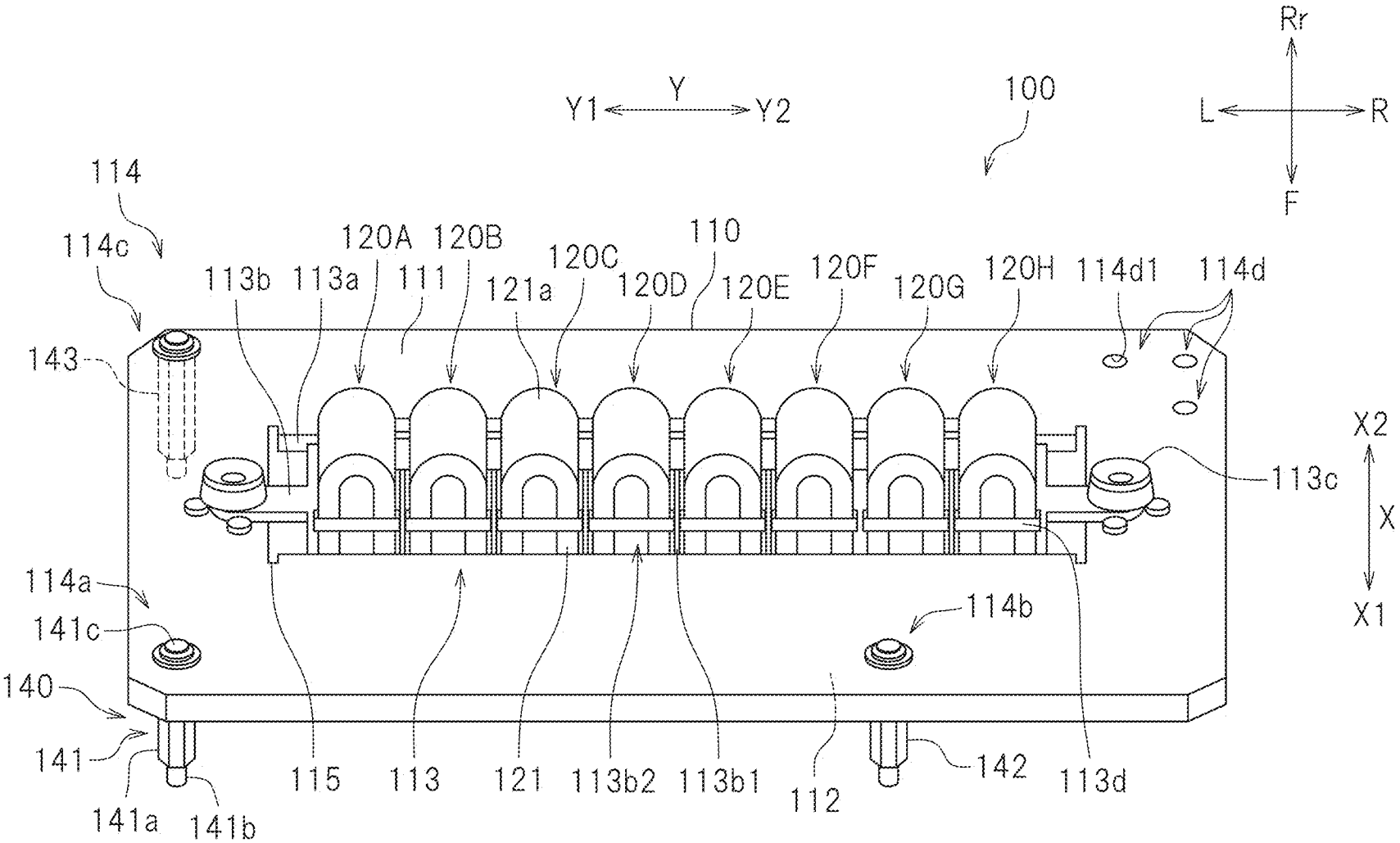
FIG. 4B is a diagram illustrating the cleaning unit shown in FIG. 4A, from which an absorber, a sheet retainer, and a fourth leg are removed.

FIGS. 4A and 4B are perspective views of the cleaning unit 100. FIG. 4A is a diagram illustrating the cleaning unit 100 with all of its components. FIG. 4B is a diagram illustrating the cleaning unit 100 shown in FIG. 4A, from which an absorber 122, a sheet retainer 130, and a fourth leg 144 are removed. In FIG. 4A, the absorber 122 is identified by the chain double-dashed lines. As illustrated in FIGS. 4A and 4B, the cleaning unit 100 includes a base 110, the cleaners 120A to 120H, the sheet retainer 130, and a leg assembly 140.

The base 110 has a plate shape. An upper surface 111 of the base 110 is provided with the cleaners 120A to 120H. A lower surface 112 of the base 110 is provided with the leg assembly 140. The sheet retainer 130 is attached to and detached from the base 110. The base 110 includes, for example, metal. As illustrated in FIG. 4B, the base 110 includes a close contact structure retainer 113, leg fitting portions 114, and mounting grooves 115 for the sheet retainer 130.

The close contact structure retainer 113 is provided on the upper surface 111 of the base 110. The close contact structure retainer 113 retains close contact structures 121 of the cleaners 120A to 120H. The close contact structure retainer 113 includes a recess 113*a*. The recess 113*a* is recessed by one step from the upper surface 111 of the base 110. The recess 113*a* extends in the main scanning direction Y. A retaining bed 113*b* is capable of being located in the recess 113*a*. The retaining bed 113*b* also extends in the main scanning direction Y. The retaining bed 113*b* includes, for example, sheet metal. The retaining bed 113*b* includes a plurality of dividers 113*b*1. The dividers 113*b*1 divide the bottom surface of the retaining bed 113*b* into eight regions in the main scanning direction Y. The divided regions define eight frames 113*b*2, for example. The retaining bed 113*b* is secured to the base 110 with bolts 113*c*.

According to the structures of the leg fitting portions 114, the legs 141 to 144 of the leg assembly 140 are attachable to and detachable from the base 110. The base 110 is provided with more than one leg fitting portion 114. In this preferred embodiment, the leg fitting portions 114 are through holes passing through the base 110 in the up-down direction Z. The leg fitting portions 114 include a first fitting portion 114*a*, a second fitting portion 114*b*, a third fitting portion 114*c*, and fourth fitting portions 114*d*. The first fitting portion 114*a* is provided adjacent to or in a vicinity of the left front end of the base 110. The second fitting portion 114*b* is provided adjacent to or in a vicinity of the right front end of the base 110. The third fitting portion 114*c* is provided adjacent to or in a vicinity of the left rear end of the base 110. More than one fourth fitting portion 114*d* is provided adjacent to or in a vicinity of the right rear end of the base 110. A user is thus able to select the fitting portion, into which the fourth leg 144 is to be fitted, from among the fourth fitting portions 114*d*. The relationship of the fourth fitting portions 114*d* with the fourth leg 144 will be described below.

Each mounting groove 115 for the sheet retainer 130 faces a corresponding one of the right and left ends of the recess 113*a* of the close contact structure retainer 113. The length of each mounting groove 115 in the sub-scanning direction X is longer than the length of the recess 113*a* in the sub-scanning direction X. The length of each mounting groove 115 in the sub-scanning direction X is longer than the length of each mounting groove 115 in the main scanning direction Y.

The cleaning unit 100 includes the cleaners 120A to 120H. The cleaners 120A to 120H are provided on the upper surface 111 of the base 110. The cleaners 120A to 120H are located side by side in the main scanning direction Y. The cleaners 120A to 120H clean the ink heads 40A to 40D of the printer 10. The cleaners 120A to 120H face the ink heads 40A to 40D upon attaching of the cleaning unit 100 to the table 30. Each of the cleaners 120A to 120H includes the close contact structure 121 and the absorber 122. In the present preferred embodiment, the absorber 122 is shared by all of the cleaners 120A to 120H as will be described below.

Each close contact structure 121 includes a flexible material. Each close contact structure 121 includes, for example, rubber. Each close contact structure 121 more preferably includes, for example, silicone rubber having a hardness between 5 degrees and 20 degrees inclusive. Each close contact structure 121 is provided by bending a flat plate material. The flat plate material of each close contact structure 121 is bent into an outwardly bulged shape and kept in the bent state by the close contact structure retainer 113. More specifically, the materials of the close contact structures 121 are inserted into the frames 113*b*2 defined by the dividers 113*b*1 of the retaining bed 113*b*. In this process, the material of each close contact structure 121 is bent at its substantially central position in the main scanning direction Y, and the ends of the material of each close contact structure 121 are inserted into the corresponding frame 113*b*2. The ends of the material of each close contact structure 121 are inserted into the corresponding frame 113*b*2 and the ends are located side by side in the main scanning direction Y. Each close contact structure 121 thus defines a convex surface 121*a* whose center in the main scanning direction Y bulges in a direction opposite to the base 110. The convex surface 121*a* is a curved surface. A cross-sectional shape of the convex surface 121*a* of each close contact structure 121 extends in the sub-scanning direction X. Each convex surface 121*a* has a cross-sectional shape that remains unchanged in the sub-scanning direction X. Each close contact structure 121 is formed into a saddle shape.

Because the close contact structures 121 each have a saddle shape, spaces are provided below the convex surfaces 121*a*. The close contact structures 121 are thus deformable in accordance with not only their own flexibility but also deformation of the spaces. The close contact structures 121 are secured with binders 113*d* of the close contact structure retainer 113. The binders 113*d* bind the close contact structures 121 and the ends of each close contact structure 121 are secured to each other.

The absorber 122 includes an ink-absorbing sheet material. In this preferred embodiment, the absorber 122 includes a nonwoven fabric. The single absorber 122 is used for more than one close contact structure 121. The absorber 122 is put over the close contact structures 121 provided side by side in the main scanning direction Y. The absorber 122 is attachable to and detachable from the close contact structures 121. The length of the absorber 122 in the main scanning direction Y is longer than the length of the close contact structures 121 provided side by side in the main scanning direction Y. The length of the absorber 122 in the sub-scanning direction X is longer than the length of each close contact structure 121 in the sub-scanning direction X. The absorber 122 is thus placeable on the close contact structures 121 to cover the close contact structures 121 from above.

The absorber 122 is retained by the sheet retainer 130. The sheet retainer 130 has a box shape whose surface adjacent to or in a vicinity of the base 110 (which is the lower surface of the sheet retainer 130) is provided with an opening. The sheet retainer 130 extends in the main scanning direction Y. The upper surface of the sheet retainer 130 is provided with an opening 131. The opening 131 is designed to allow the close contact structures 121 provided side by side in the main scanning direction Y to pass therethrough. The convex surfaces 121*a* of the close contact structures 121 thus protrude above the opening 131 upon attaching of the sheet retainer 130 to the base 110. The lower ends of lateral surfaces of the sheet retainer 130 facing in the main scanning direction Y each include a lug 132. The sheet retainer 130 is fitted to the base 110 by fitting the lugs 132 into the mounting grooves 115 of the base 110.

Lateral surfaces of the sheet retainer 130 facing in the sub-scanning direction X define sheet holders 133. The sheet holders 133 protrude downward from the upper surface of the sheet retainer 130 and extend in the main scanning direction Y. The sheet holders 133 press the absorber 122 over portions of the close contact structures 121 located in the first sub-scanning direction X1 and portions of the close contact structures 121 located in the second sub-scanning direction X2. The sheet retainer 130 presses the absorber 122 against the close contact structures 121. As a result, the absorber 122 is provided along the outer peripheries of the convex surfaces 121*a* of the close contact structures 121 and thus curved along the convex surfaces 121*a*. The sheet retainer 130 retains the absorber 122, and the absorber 122 is detachable from the sheet retainer 130.

Ends of the sheet retainer 130 in the main scanning direction Y do not press the absorber 122 and thus do not restrict the absorber 122 from moving. The lateral surfaces of the sheet retainer 130 facing in the main scanning direction Y do not include any downwardly protruding portions, for example, the sheet holders 133. The lateral surfaces of the sheet retainer 130 facing in the main scanning direction Y define freeing portions 134 that free the absorber 122 in the main scanning direction Y. The absorber 122 is thus movable in the main scanning direction Y upon attaching of the sheet retainer 130 to the base 110. Accordingly, the absorber 122 extends along the outer peripheries of the close contact structures 121.

In the present preferred embodiment, each of the cleaners 120A to 120H includes the close contact structure 121 and the absorber 122. The cleaners 120A to 120H, however, are not limited to this particular structure. The cleaners 120A to 120H may each include a convex surface S1, and each convex surface S1 may include a flexible ink-absorbing material. In one example, the cleaners 120A to 120H may each include a single material. In this case, the material for each of the cleaners 120A to 120H preferably has both of flexibility and ink absorptivity, for example. The cleaners 120A to 120H may each include, for example, a moderately elastic sponge. The length of each of the cleaners 120A to 120H in the sub-scanning direction X is shorter than the length of the nozzle surface 42 of each of the ink heads 40A to 40D in the sub-scanning direction X. In this preferred embodiment, the length of each of the cleaners 120A to 120H in the sub-scanning direction X is slightly longer than half of the length of each nozzle surface 42 in the sub-scanning direction X.

A small amount of cleaning liquid is preferably applied to the absorber 122 at the time of cleaning of the ink heads 40A to 40D, for example. An ink dissolving liquid, for example, an ink solvent, is preferably provided as the cleaning liquid.

The leg assembly 140 is provided on the lower surface 112 of the base 110. The leg assembly 140 is installed on the table 30 of the printer 10. The leg assembly 140 of the cleaning unit 100 is an attachment attachable to and detachable from the table 30. In this preferred embodiment, the leg assembly 140 includes more than one leg, i.e., the legs 141 to 144. The first to third legs 141 to 143 have the same or similar structure. The first leg 141 includes a nut 141*a* and a tip 141*b*. As illustrated in FIGS. 4A and 4B, the outer shape of the nut 141*a* is a hexagonal prism extending in the up-down direction Z. The nut 141*a* extends outward of the corresponding leg fitting portion 114 of the base 110 in a plan view. The nut 141*a* is provided with a threaded hole extending in the up-down direction Z. The nut 141*a* is secured to the base 110 by fastening a bolt 141*c* into the threaded hole. The leg assembly 140 is located inward of the visible outline of the base 110 in the plan view. The leg assembly 140 thus does not project out of the base 110, making the cleaning unit 100 compact in size.

The tip 141*b* is provided on the lower end of the nut 141*a*. The tip 141*b* has a circular cylindrical shape smaller in outside diameter than the nut 141*a*. A step is created on the boundary between the nut 141*a* and the tip 141*b*. The outside diameter of the tip 141*b* corresponds to the inside diameter of each of the fitting holes 31*a* to 31*c* of the table 30. The first leg 141 is inserted into the first fitting hole 31*a* of the table 30. Positioning of the first leg 141 in the main scanning direction Y and the sub-scanning direction X is effected by inserting the tip 141*b* into the first fitting hole 31*a*. Positioning of the first leg 141 in the up-down direction Z is effected by bringing the nut 141*a* into abutment with the table 30. Similar features and structures apply to the second leg 142 and the third leg 143. The second leg 142 is inserted into the second fitting hole 31*b* of the table 30. The third leg 143 is inserted into the third fitting hole 31*c* of the table 30. The leg assembly 140 defines and functions as a second positioner associated with the first positioner (i.e., the fitting holes 31*a* to 31*c* in this preferred embodiment) provided in the table 30.

The fourth leg 144 is attachable to and detachable from any one of the fourth fitting portions 114*d* of the base 110. As described above, more than one fourth fitting portion 114*d* is provided. The number of fourth fitting portions 114*d* into which the fourth leg 144 is attachable is larger than the number of fourth legs 144. Accordingly, the position of the fourth leg 144 on the base 110 is shiftable by changing the fourth fitting portion 114*d* into which the fourth leg 144 is to be fitted. In this preferred embodiment, the number of fourth legs 144 is one, and the number of fourth fitting portions 114*d* is three. The number of legs whose positions on the base 110 are shiftable is not limited to one but may be two or more. The number of leg fitting portions into which the shiftable leg(s) is/are attachable is only required to be larger than the number of legs. No further limitations are imposed on the number of leg fitting portions into which the shiftable leg(s) is/are attachable.

As illustrated in FIG. 2, the shiftable range of the fourth leg 144 is set within the printing area A1 of the table 30. Accordingly, all of the fourth fitting portions 114*d* are located within the printing area A1 in the plan view. The shiftable range of the fourth leg 144, however, is only required to at least partially overlap with the printing area A1 of the table 30. An entirety of the shiftable range does not necessarily have be located within the printing area A1. In other words, the fourth leg 144 may be shifted to a position outside the printing area A1. The fourth leg 144 includes a nut. The fourth leg 144 is thus secured to the base 110 with a bolt. Because the fourth leg 144 does not necessarily have to be placed on a portion of the table 30 where a hole is defined, the fourth leg 144 has a tipless shape.

Figure 5:
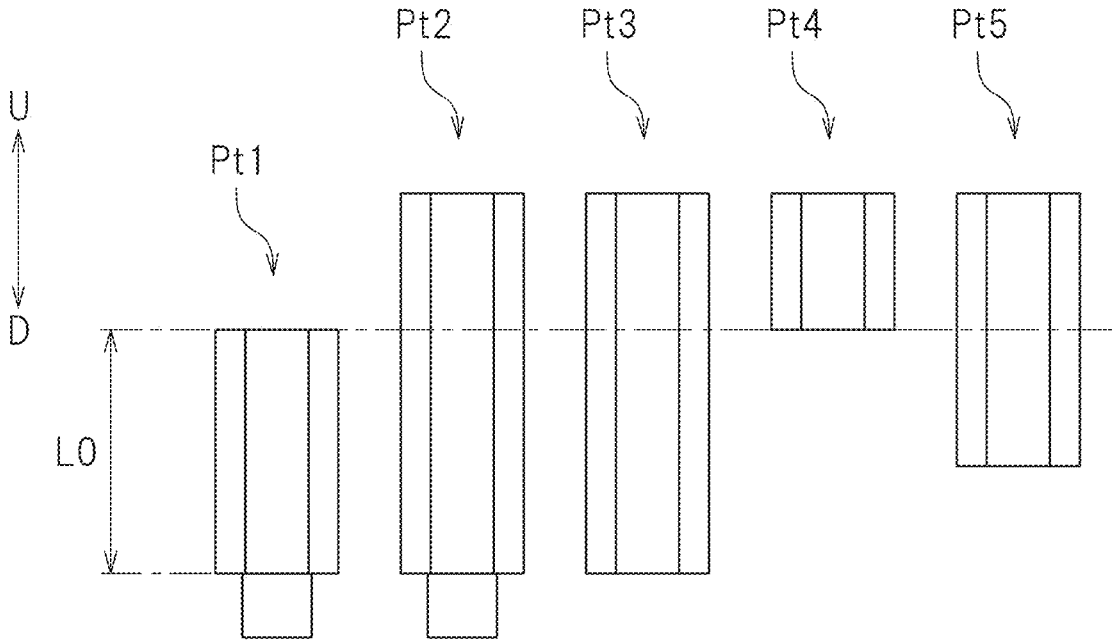
FIG. 5 is a diagram illustrating examples of leg portions.

The leg assembly 140 is changeable in length. In the present preferred embodiment, each of the legs 141 to 144 is changeable in length. Each of the first to fourth legs 141 to 144 includes one of leg portions attachable to the base 110 and different in length. FIG. 5 is a diagram illustrating examples of leg portions. As illustrated in FIG. 5, the examples of the leg portions include five types of leg portions, i.e., first to fifth leg portions Pt1 to Pt5. The leg portions Pt1 to Pt5 include nuts different in length. The leg portions Pt1 to Pt5 include ones with tips and ones with no tips. A leg portion selecting method will be described below.

The following description discusses attaching of the cleaning unit 100 to the printer 10 and cleaning operation for the ink heads 40A to 40D. First, attaching of the cleaning unit 100 to the printer 10 will be described.

According to the present preferred embodiment, the cleaning unit 100 is attachable to the table 30 without having to remove the jig 200. The base 110 of the cleaning unit 100 is raised above the jig 200 by the leg assembly 140. The user selects the leg portions with lengths suitable to raise the base 110. A length L0 illustrated in FIG. 5 corresponds to the thickness of the jig 200. In order for the base 110 to avoid the jig 200, the leg assembly 140 raises the height of the lower surface 112 of the base 110 above the jig thickness L0. The leg portion Pt2 is thus selected for the first to third legs 141 to 143. The length of the nut of the leg portion Pt2 is longer than the jig thickness L0. The length of the leg portion Pt1, which is another leg portion for the first to third legs 141 to 143, is equal or substantially equal to the jig thickness L0. The first to third legs 141 to 143 are legs that stand outside the printing area A1 of the table 30. Accordingly, the length of each of the first to third legs 141 to 143 is longer than the thickness L0 of the jig 200.

As illustrated in FIG. 2, the fourth leg 144 stands inside the printing area A1. The user is able to select the fourth fitting portion 114*d* into which the fourth leg 144 is to be fitted. The user thus selects a location where the fourth leg 144 will stand on the table 30. In the example illustrated in FIG. 2, a fourth fitting portion 114*d*1, which is one of the fourth fitting portions 114*d*, is located over the corresponding holder 210 of the jig 200. Each holder 210 is a through hole defined in the jig 200. The user is thus able to select the fitting portion 114*d*1 as the leg fitting portion into which the fourth leg 144 is to be fitted. By selecting the fitting portion 114*d*1, the fourth leg 144 is able to stand on the table 30.

Accordingly, the cleaning unit 100 is able to be stably installed on the table 30. In this example, the user selects the leg portion Pt3 as the fourth leg 144. The nut of the leg portion Pt3 is equal or substantially equal in length to the nut of the leg portion Pt2. The leg portion Pt3 is a leg portion with no tip.

When unable to pass the fourth leg 144 through the corresponding holder 210 of the jig 200, the user may place the fourth leg 144 on the jig 200. In this case, the user selects the leg portion Pt4 as the fourth leg 144. The length of the nut of the leg portion Pt4 is equal or substantially equal to the difference between the height of the leg portion Pt2 and the thickness L0 of the jig 200. The leg portion Pt4 is a leg portion with no tip.

Although FIG. 5 illustrates only five types of leg portions (i.e., the leg portions Pt1 to pt5), leg portions having various other lengths may be prepared. Leg portions may be prepared under the assumption that the jig 200 is manufactured from a material with a standardized thickness. Assuming that the jig 200 is manufactured from a material with a standardized thickness, the lengths of leg portions to be prepared are limited to a particular combination. Accordingly, such a method is able to reduce the number of types of leg portions. Alternatively, leg portions whose lengths vary in steps of 1 mm, for example, may be prepared without making any assumption about the thickness of the jig 200. If the jig 200 is unavailable, the leg assembly 140 would define and function as the positioner on the cleaning unit 100.

After selection of the leg portions and attaching of the legs 141 to 144 to the base 110, the cleaning unit 100 is fitted to the cleaning unit installation portion 30*a*. This fitting process is performed by respectively inserting the first to third legs 141 to 143 into the first to third fitting holes 31*a* to 31*c* of the table 30. Such a process facilitates positioning of the cleaning unit 100 with respect to the printer 10. In this process, the fourth leg 144 is not involved in the positioning of the cleaning unit 100 but functions to stably install the cleaning unit 100 on the printer 10.

The cleaners 120A to 120H face the ink heads 40A to 40D by fitting the cleaning unit 100 to the table 30. Specifically, the convex surfaces S1 of the cleaners 120A to 120H face toward the ink heads 40A to 40D. The close contact structures 121 of the cleaners 120A to 120H are located closer to the table 30 than the absorber 122. The absorber 122 of the cleaners 120A to 120H is located closer to the ink heads 40A to 40D than the close contact structures 121.

The cleaning operation for the ink heads 40A to 40D will be described below. In the present preferred embodiment, the conveyor 50 moves the ink heads 40A to 40D relative to the table 30, with the cleaning unit 100 fitted to the table 30. The ink heads 40A to 40D thus move relative to the cleaning unit 100. The operations of the conveyor 50 are controlled by the cleaning controller 91. With this relative movement, the ink heads 40A to 40D are cleaned.

Figure 6:
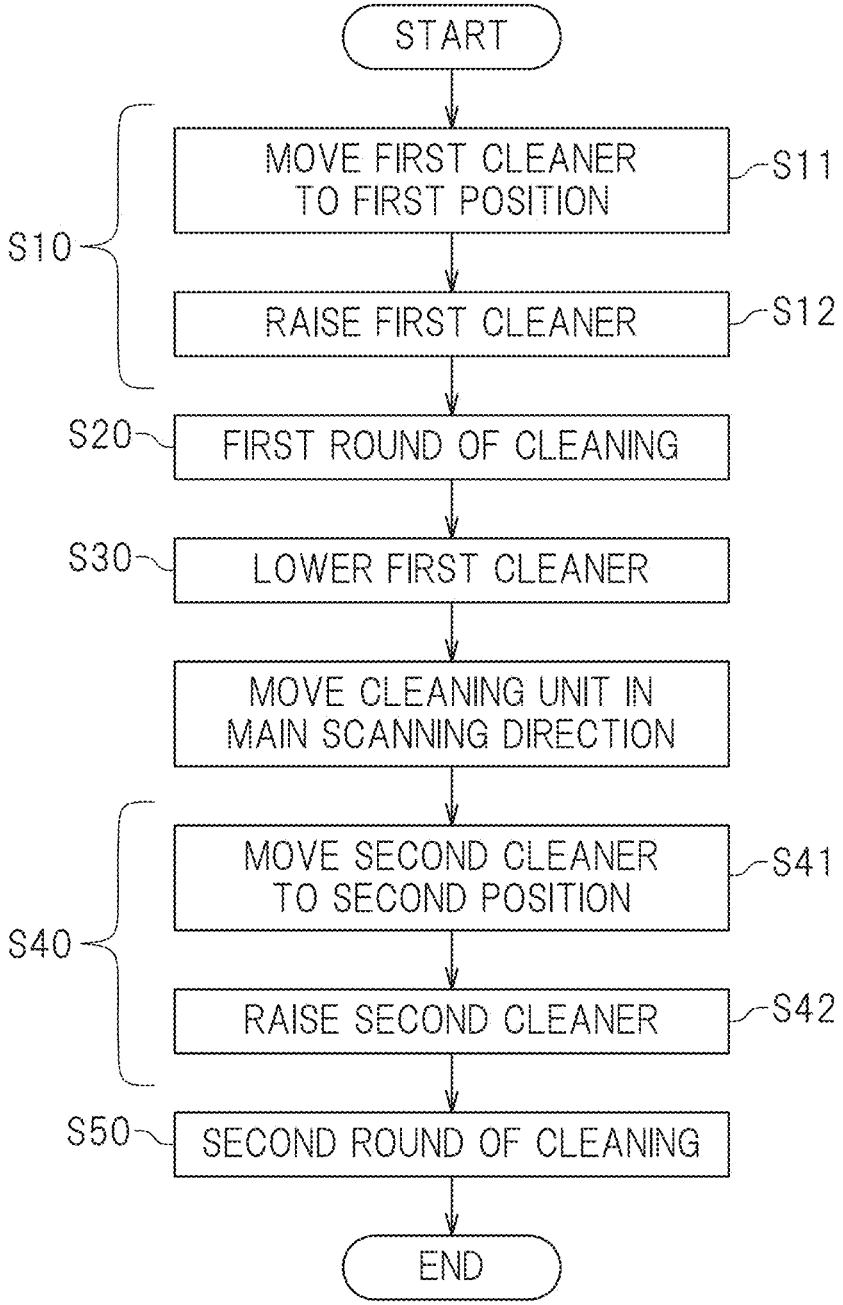
FIG. 6 is a flow chart illustrating a cleaning operation for a first ink head.

FIG. 6 is a flow chart illustrating the cleaning operation for the first ink head 40A. As illustrated in FIG. 6, the cleaning operation for the first ink head 40A includes five steps, i.e., Steps S10 to S50. More specifically, the first step S10 includes Step S11 and Step S12. The fourth step S40 includes Step S41 and Step S42. The present preferred embodiment involves performing, after the third step S30 and before the fourth step S40, a sliding operation to move the cleaning unit 100 relative to the ink heads 40A to 40D in the main scanning direction Y. Although described below, the sliding operation is optional in some preferred embodiments.

Figure 7A:
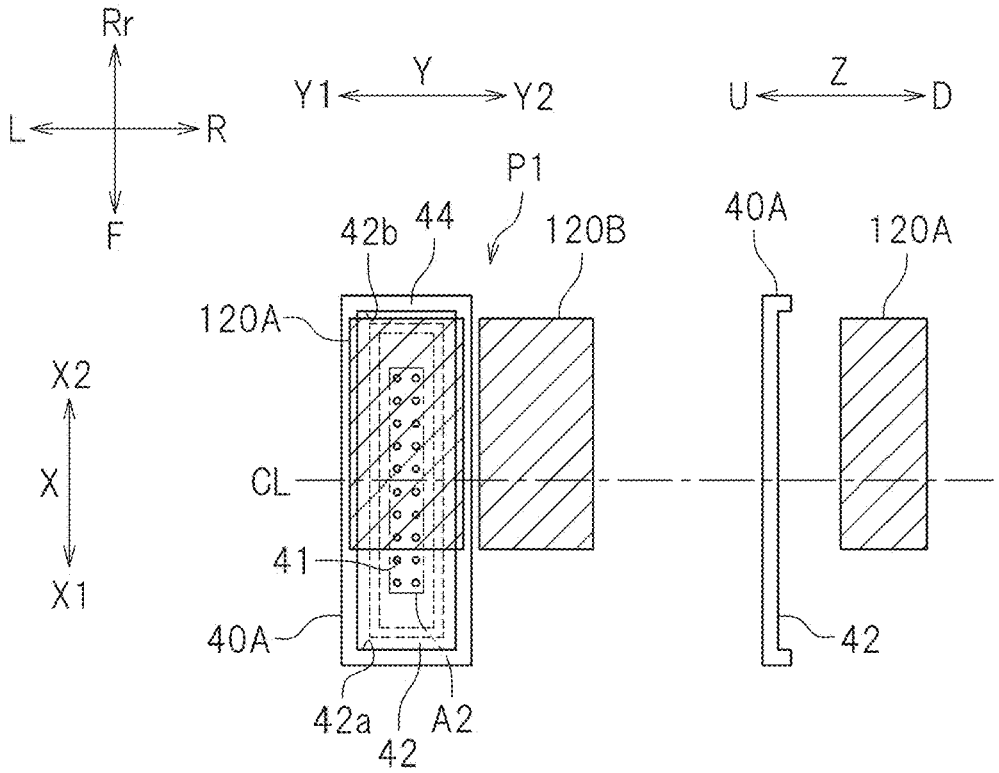
FIG. 7A is a diagram illustrating positional relationships among the first ink head, a first cleaner, and a second cleaner in Step S11.
Figure 7B:
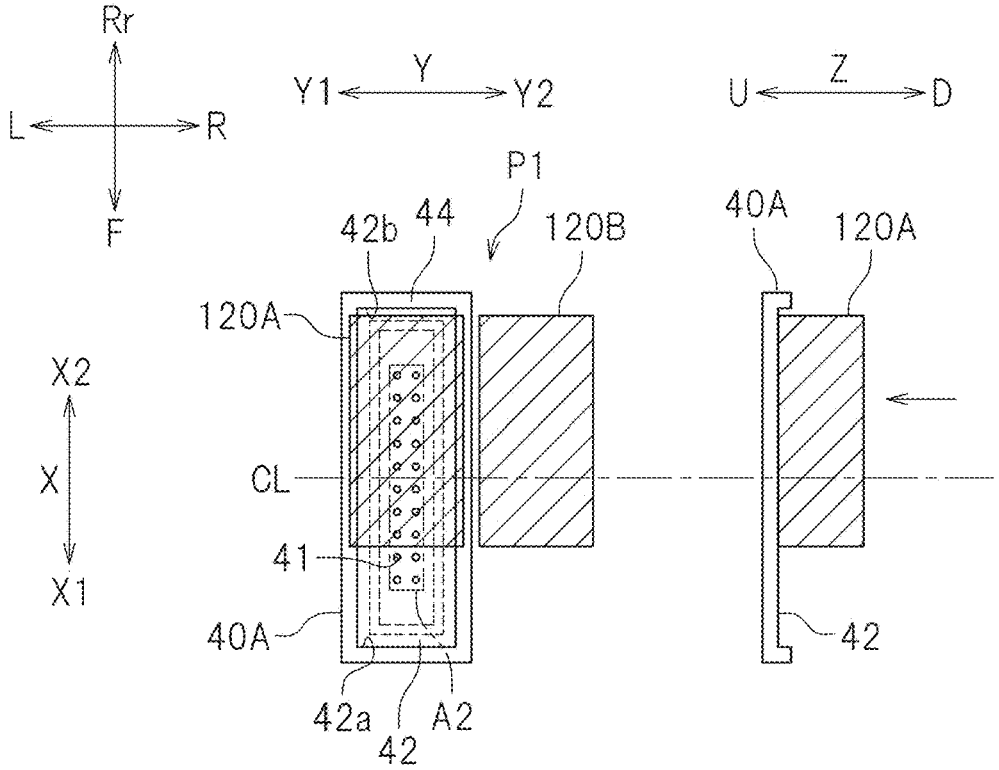
FIG. 7B is a diagram illustrating positional relationships among the first ink head, the first cleaner, and the second cleaner in Step S12.
Figure 7C:
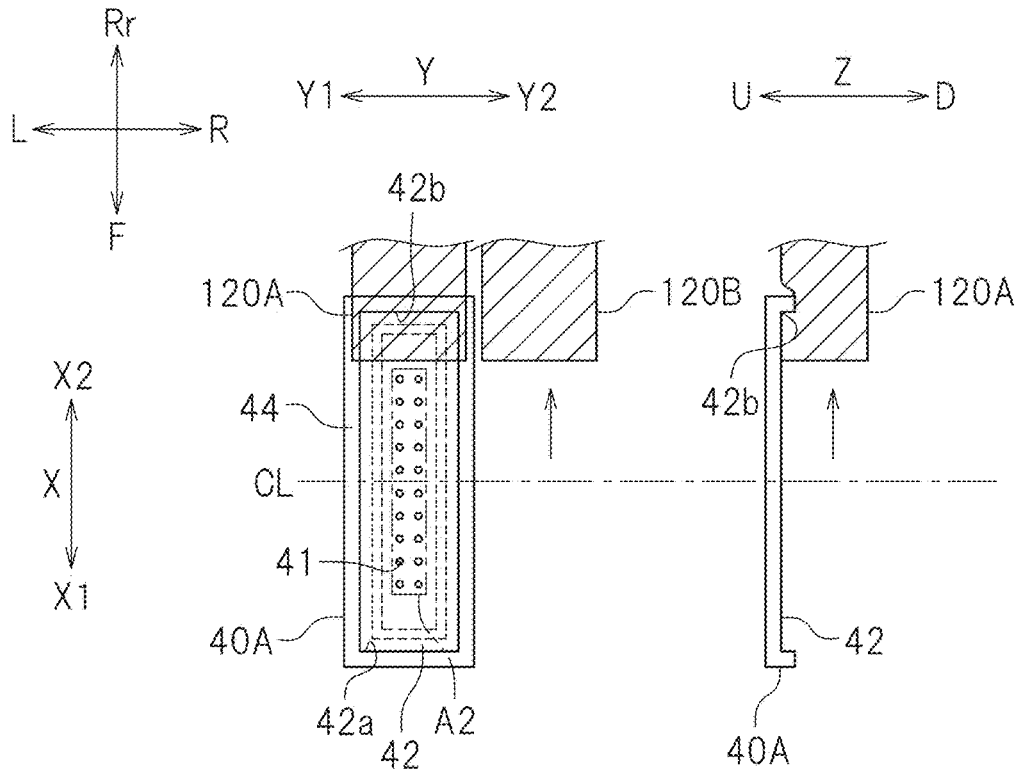
FIG. 7C is a diagram illustrating positional relationships among the first ink head, the first cleaner, and the second cleaner in Step S20.
Figure 7D:
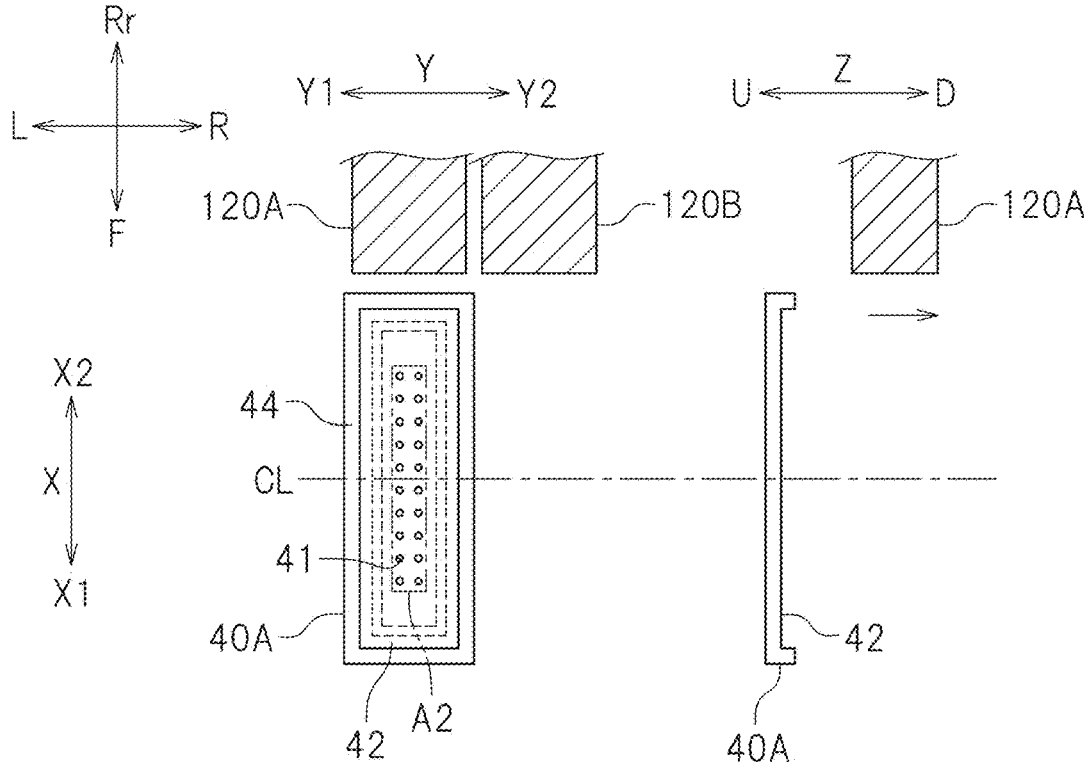
FIG. 7D is a diagram illustrating positional relationships among the first ink head, the first cleaner, and the second cleaner in Step S30.
Figure 7E:
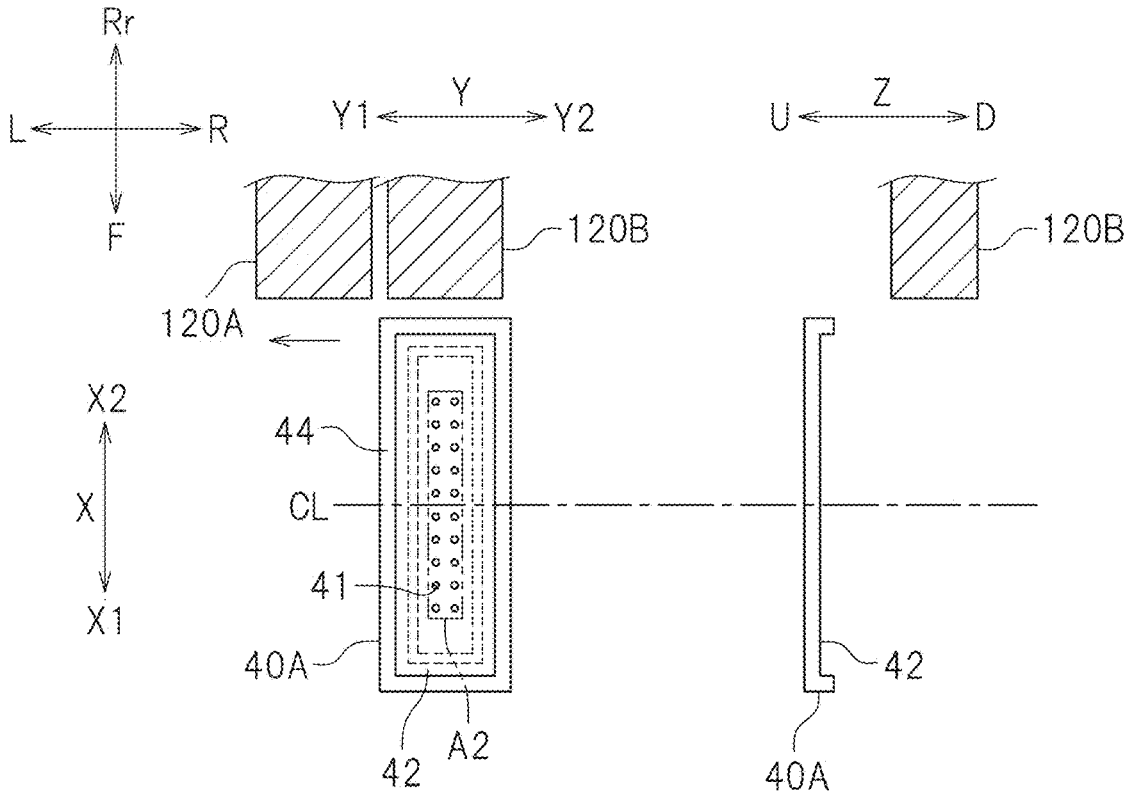
FIG. 7E is a diagram illustrating positional relationships among the first ink head, the first cleaner, and the second cleaner during sliding operation.
Figure 7F:
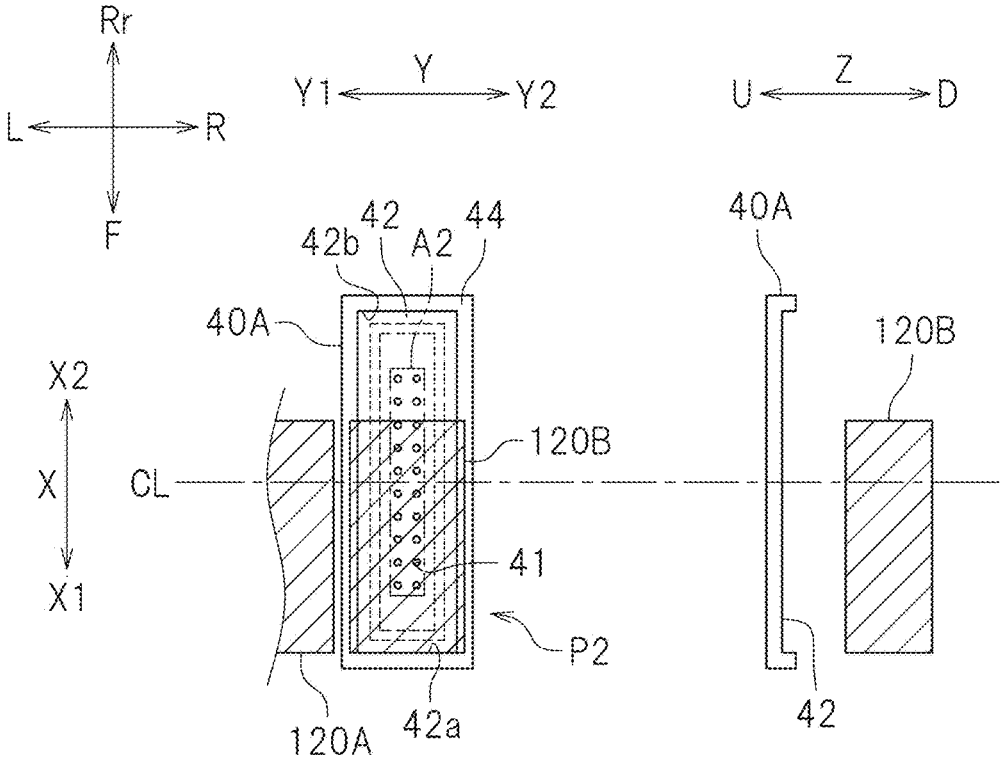
FIG. 7F is a diagram illustrating positional relationships among the first ink head, the first cleaner, and the second cleaner in Step S41.
Figure 7G:
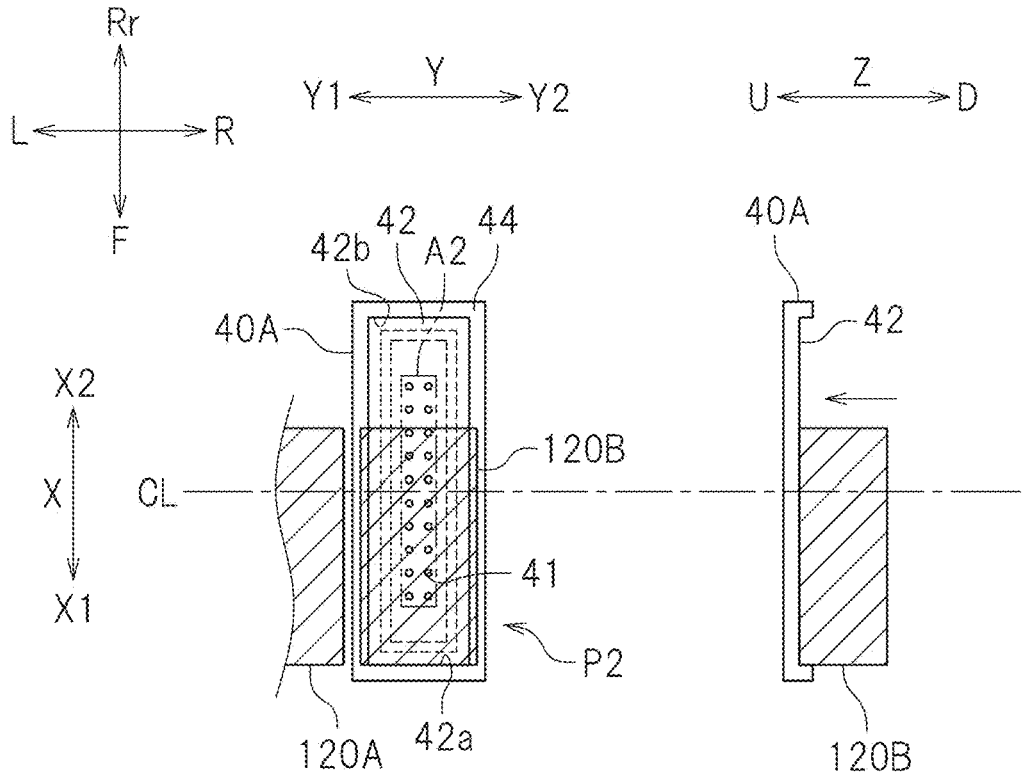
FIG. 7G is a diagram illustrating positional relationships among the first ink head, the first cleaner, and the second cleaner in Step S42.
Figure 7H:
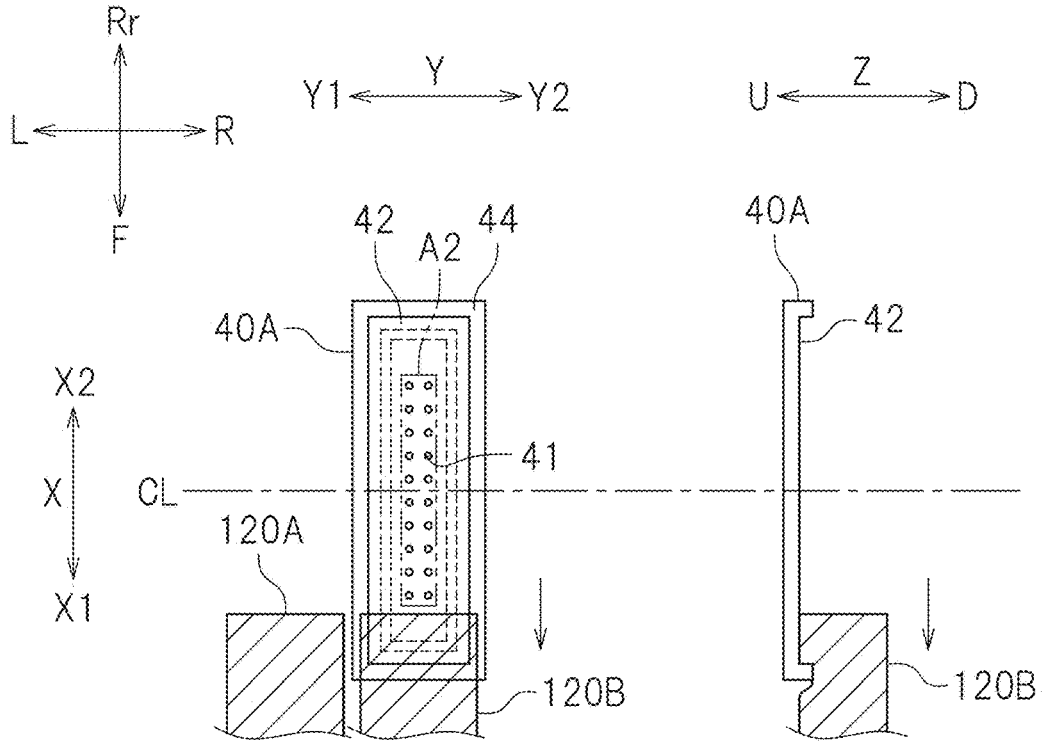
FIG. 7H is a diagram illustrating positional relationships among the first ink head, the first cleaner, and the second cleaner in Step S50.

FIGS. 7A to 7H are diagrams illustrating positional relationships among the first ink head 40A, the first cleaner 120A, and the second cleaner 120B during the cleaning operation. FIG. 7A illustrates the positional relationships among the first ink head 40A, the first cleaner 120A, and the second cleaner 120B in Step S11. FIG. 7B illustrates the positional relationships among the first ink head 40A, the first cleaner 120A, and the second cleaner 120B in Step S12. FIG. 7C illustrates the positional relationships among the first ink head 40A, the first cleaner 120A, and the second cleaner 120B in Step S20. FIG. 7D illustrates the positional relationships among the first ink head 40A, the first cleaner 120A, and the second cleaner 120B in Step S30. FIG. 7E illustrates the positional relationships among the first ink head 40A, the first cleaner 120A, and the second cleaner 120B during the sliding operation. FIG. 7F illustrates the positional relationships among the first ink head 40A, the first cleaner 120A, and the second cleaner 120B in Step S41. FIG. 7G illustrates the positional relationships among the first ink head 40A, the first cleaner 120A, and the second cleaner 120B in Step S42. FIG. 7H illustrates the positional relationships among the first ink head 40A, the first cleaner 120A, and the second cleaner 120B in Step S50. The left side of each of FIGS. 7A to 7H is a plan view. The right side of each of FIGS. 7A to 7H is a side view.

As illustrated in FIG. 6, Step S11 involves moving the first cleaner 120A to a first position P1 located under the first ink head 40A. Movement of the cleaning unit 100 is effected by moving the first ink head 40A by the carriage conveying device 60 and moving the table 30 by the table conveying device 70. Positioning of the cleaning unit 100 with respect to the table 30 is effected by the leg assembly 140 and the fitting holes 31*a* to 31*c*. The cleaning controller 91 is thus able to place the cleaning unit 100 and the table 30 at predetermined relative positions.

As illustrated in the plan view of FIG. 7A, the first cleaner 120A at the first position P1 overlaps with a portion of the nozzle surface 42 located in the second sub-scanning direction X2 relative to the first end 42*a*. More specifically, the front end of the first cleaner 120A is located in the first sub-scanning direction X1 relative to a central line CL passing through the center of the nozzle forming region A2 in the sub-scanning direction X. As illustrated in the side view of FIG. 7A, the first cleaner 120A at this position is located under the first ink head 40A at a distance therefrom.

Step S12 involves moving the cleaning unit 100 upward. This brings the first cleaner 120A into contact with the nozzle surface 42 of the first ink head 40A. More specifically, the first cleaner 120A comes into contact with a portion of the nozzle surface 42 located in the second sub-scanning direction X2 relative to the first end 42*a*. In the present preferred embodiment, the rear end of the first cleaner 120A also comes into contact with the nozzle surface 42. The first cleaner 120A comes into contact with a portion of the nozzle surface 42 located between the first end 42*a* and the second end 42*b*.

The second step S20 involves performing a first round of cleaning. In the second step S20, the cleaning controller 91 moves the first cleaner 120A in the second sub-scanning direction X2 while keeping the first cleaner 120A in contact with the nozzle surface 42 of the first ink head 40A as illustrated in FIG. 7C. This cleans a little more than one-half of a portion of the nozzle surface 42 of the first ink head 40A located in the second sub-scanning direction X2.

Figure 8:
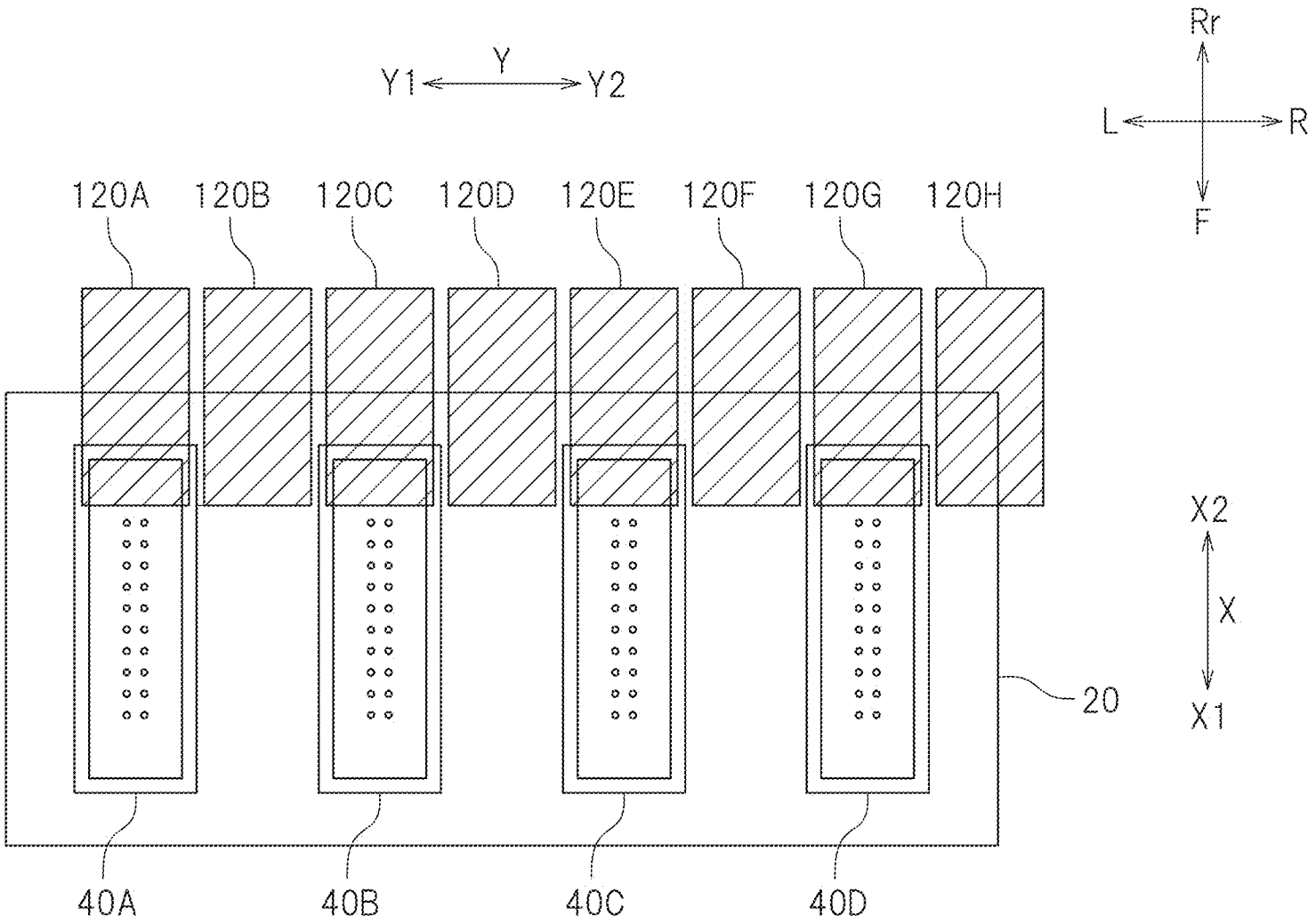
FIG. 8 is a plan view of the carriage and the cleaning unit, illustrating a positional relationship therebetween at a time point in Step S20.

FIG. 8 is a plan view of the ink heads 40A to 40D and the cleaners 120A to 120H, illustrating positional relationships therebetween at a time point in the second step S20. As illustrated in FIG. 8, the position of the second ink head 40B corresponds to the position of the third cleaner 120C in the main scanning direction Y in the second step S20. The second ink head 40B is thus cleaned by the third cleaner 120C in the second step S20. Similarly, the third ink head 40C is cleaned by the fifth cleaner 120E. The fourth ink head 40D is cleaned by the seventh cleaner 120G. Pitches between adjacent ones of the cleaners 120A to 120H in the main scanning direction Y are set to be half as large as pitches between adjacent ones of the ink heads 40A to 40D in the main scanning direction Y. The ink heads 40A to 40D are thus cleaned simultaneously by the cleaners 120A, 120C, 120E, and 120G provided in the main scanning direction Y. The cleaners 120A, 120C, 120E, and 120G are provided alternately with the cleaners 120B, 120D, 120F, and 120H in the main scanning direction Y.

The structure of the first cleaner 120A achieves advantageous effects in cleaning the first ink head 40A. The first cleaner 120A includes the convex surface S1 bulging toward the first ink head 40A. The convex surface S1 has flexibility and ink absorptivity. Because the flexible convex surface S1 bulges toward the first ink head 40A, the degree of close contact between the first cleaner 120A and the nozzles 41 will be higher than when the cleaner has a flat upper end, for example. In particular, the first ink head 40A includes the head guard 44. Thus, if the cleaner has a flat upper end, the head guard 44 will get in the way, and the cleaner often does not come into contact with the nozzles 41 successfully. When an ink head includes a portion (for example, a head guard) protruding from a nozzle forming region, the convex surface S1 achieves particularly advantageous effects. The first cleaner 120A has ink absorptivity and absorbs ink to clean the nozzles 41.

In the present preferred embodiment, the first cleaner 120A extends in the sub-scanning direction X while maintaining the upwardly bulging cross-sectional shape. According to the upwardly bulging cross-sectional shape, the first cleaner 120A is able to absorb ink from the nozzles 41 simultaneously over a wide range in the sub-scanning direction X.

In the present preferred embodiment, the first cleaner 120A includes the close contact structure 121 and the absorber 122. Features that the first cleaner 120A should have include flexibility, and the close contact structure 121 has flexibility. Features that the first cleaner 120A should have include ink absorptivity, and the absorber 122 has ink absorptivity. Combining the features as described above only requires replacement of the absorber 122, which has absorbed ink, after cleaning. This results in saving of consumables.

The close contact structure 121 is provided by bending a flat plate material. A space is thus created under the convex surface 121*a*. This space allows the close contact structure 121 to deform largely in the up-down direction Z. Accordingly, a force of the first cleaner 120A that presses the first ink head 40A during contact is kept substantially constant irrespective of variations in the distance between the first ink head 40A and the first cleaner 120A.

In the present preferred embodiment, the rear end of the first cleaner 120A is located in the first sub-scanning direction X1 relative to the second end 42*b* at the start of Step S20 to clean the second end 42*b* effectively. The second end 42*b*, which is a portion of the boundary between the head guard 44 and the nozzle surface 42, defines a step. The step is likely to store ink. The ink stored is resistant to removal by cleaning. The cleaning system 1 according to the present preferred embodiment, however, involves passing the rear end of the first cleaner 120A through the second end 42*b* in the second step S20. Accordingly, the corners of the rear end of the first cleaner 120A enter a step region to effectively remove ink on the second end 42*b*.

The above features are similarly provided between the second ink head 40B and the third cleaner 120C, between the third ink head 40C and the fifth cleaner 120E, and between the fourth ink head 40D and the seventh cleaner 120G.

In the third step S30, the cleaning controller 91 lowers the cleaning unit 100 as illustrated in FIG. 7D. The cleaning controller 91 thus moves the first cleaner 120A away from the nozzle surface 42. The third controller 91*c* moves the cleaning unit 100, for example, in the up-down direction Z to move the cleaning unit 100 away from the nozzle surface 42. The direction of movement in this case, however, is only required to be a direction non-parallel to the nozzle surface 42 and does not necessarily have to correspond to the up-down direction Z.

As illustrated in FIG. 7E, the cleaning controller 91 moves the cleaning unit 100 relative to the first ink head 40A in the first main scanning direction Y1 during the sliding operation. This movement is actually performed by movement of the carriage 20 in the second main scanning direction Y2. As illustrated in FIG. 7E, a distance by which the first ink head 40A moves during the sliding operation is equal or substantially equal to the pitch of the cleaner 120A to 120H in the main scanning direction Y. The first ink head 40A thus moves to a position where the first ink head 40A is in alignment with the second cleaner 120B in the sub-scanning direction X. During the sliding operation, the second ink head 40B moves to a position where the second ink head 40B is in alignment with the fourth cleaner 120D in the sub-scanning direction X. The third ink head 40C moves to a position where the third ink head 40C is in alignment with the sixth cleaner 120F in the sub-scanning direction X. The fourth ink head 40D moves to a position where the fourth ink head 40D is in alignment with the eighth cleaner 120H in the sub-scanning direction X.

As illustrated in the plan view of FIG. 7F, Step S41 involves moving the second cleaner 120B to a second position P2 located under the first ink head 40A. As illustrated in FIG. 7F, the second cleaner 120B at the second position P2 overlaps with a portion of the nozzle surface 42 located in the first sub-scanning direction X1 relative to the second end 42*b*. More specifically, the rear end of the second cleaner 120B is located in the second sub-scanning direction X2 relative to the central line CL in the sub-scanning direction X. As illustrated in the side view of FIG. 7F, the second cleaner 120B at this position is located under the first ink head 40A at a distance therefrom.

As illustrated in FIG. 7G, Step S42 involves moving the cleaning unit 100 upward. This brings the second cleaner 120B into contact with the nozzle surface 42 of the first ink head 40A. More specifically, the second cleaner 120B comes into contact with a portion of the nozzle surface 42 located in the first sub-scanning direction X1 relative to the second end 42*b*. In the present preferred embodiment, the front end of the second cleaner 120B also comes into contact with the nozzle surface 42. Also in this step, the second cleaner 120B comes into contact with a portion of the nozzle surface 42 located between the first end 42*a* and the second end 42*b*.

The fifth step S50 involves performing a second round of cleaning. In the fifth step S50, the cleaning controller 91 moves the second cleaner 120B in the first sub-scanning direction X1 while keeping the second cleaner 120B in contact with the nozzle surface 42 of the first ink head 40A as illustrated in FIG. 7H. This cleans a little more than one-half of a portion of the nozzle surface 42 of the first ink head 40A located in the first sub-scanning direction X1. A region cleaned in the second step S20 and a region cleaned in the fifth step S50 partially overlap with each other, and thus do not leave any region that is yet to be wiped. The second ink head 40B, the third ink head 40C, and the fourth ink head 40D are respectively cleaned by the fourth cleaner 120D, the sixth cleaner 120F, and the eighth cleaner 120H by performing similar operations.

As described above, the present preferred embodiment involves performing two separate rounds of cleaning for each ink head. Specifically, the first round of cleaning involves placing the first cleaner 120A with at least one of the ends of the first cleaner 120A located on the nozzle forming region A2 of the first ink head 40A, and then moving the first cleaner 120A outward of the nozzle forming region A2. The fifth step S50 involves performing the second round of cleaning, with the direction of movement reversed.

A known technique involves cleaning an ink head in one direction from one of the ends of a nozzle surface to the other end of the nozzle surface. The following description discusses how the first ink head 40A according to the present preferred embodiment is cleaned by the known technique. Typically, at a location outward of one of the ends of the first ink head 40A, a cleaner (for example, a wiper) is kept at a height at which the cleaner is able to come into contact with the nozzle surface 42. The cleaner is moved toward the center of the first ink head 40A while being kept at this height. As a result, the cleaner first comes into contact with the head guard 44, comes into contact with the region A3 (with which the cap 81 comes into contact), and then comes into contact with the nozzle forming region A2. As described above, an end of the nozzle surface 42 (which defines a boundary between the head guard 44 and the nozzle surface 42) is likely to store ink. When the cap 81 is attached to or detached from the corresponding ink head, ink is likely to adhere to the region A3. The cleaner will thus drag the ink (which has been removed from the end of the nozzle surface 42 or the region A3) to the nozzle forming region A2. This may cause the ink (which has been removed from the end of the nozzle surface 42 or the region A3) to adhere to the nozzles 41. In particular, when the ink (which has been removed from the end of the nozzle surface 42 or the region A3) has a solidified portion, the solidified ink may enter the nozzles 41 and cause a malfunction, for example, an ink discharge failure. As just described, ink may be adhering to a region outside the nozzle forming region A2. If such ink is brought into the nozzle forming region A2, a malfunction, for example, an ink discharge failure, may occur.

To prevent a malfunction in the printer 10 according to the present preferred embodiment, the cleaners 120A to 120H are first brought into contact with the nozzle surfaces 42, and then the cleaning unit 100 is moved outward of the nozzle surfaces 42. This operation will not bring ink, which has been removed from regions outside the nozzle forming regions A2, to the nozzle forming regions A2. Accordingly, the present preferred embodiment prevents the possibility of malfunctions in the nozzles 41 caused by such ink. The present preferred embodiment involves performing a total of two rounds of cleaning which is carried out from the center of each nozzle surface 42 to the peripheral edge of each nozzle surface 42 in different directions, thus cleaning an entirety of each nozzle surface 42.

In the first step S10 and the fourth step S40, the present preferred embodiment involves lowering the cleaning unit 100 and moving the cleaning unit 100 in the main scanning direction Y and the sub-scanning direction X, with the cleaners 120A to 120H being unable to come into contact with the ink heads 40A to 40D. This operation is able to prevent ink, which is present outside the nozzle forming regions A2, from being brought into the nozzle forming regions A2 before the first round of cleaning and the second round of cleaning.

In the present preferred embodiment, the printer 10 cleans each ink head using two cleaners. For example, the first round of cleaning for the first ink head 40A is performed using the first cleaner 120A, and the second round of cleaning for the first ink head 40A is performed using the second cleaner 120B. This operation is able to perform two rounds of cleaning using a clean cleaner each time. The ink heads 40A to 40D are thus cleaned with higher quality. In the present preferred embodiment, the nozzle rows 43*a* and 43*b* are provided side by side in the main scanning direction Y. Accordingly, the cleaners 120A to 120H are also provided side by side in the main scanning direction Y. The cleaning controller 91 performs the sliding operation of the cleaning unit 100 between the third step S30 and the fourth step S40.

In the above description, different cleaners are used for the first round of cleaning and the second round of cleaning. Alternatively, the same cleaner may be used for the first round of cleaning and the second round of cleaning. In this case, the cleaning unit 100 may include cleaners whose number is equal to the number of ink heads 40A to 40D of the printer 10, and thus the cleaning unit 100 may include four cleaners. In such a case, the sliding operation described above is unnecessary.

Several variations may be applied to the above-described preferred embodiment. Several preferred variations will be described below. In the description of the variations below, components similar to those in the above preferred embodiment are identified by the same reference signs, and description thereof will be simplified or omitted when deemed redundant.

Figure 9:
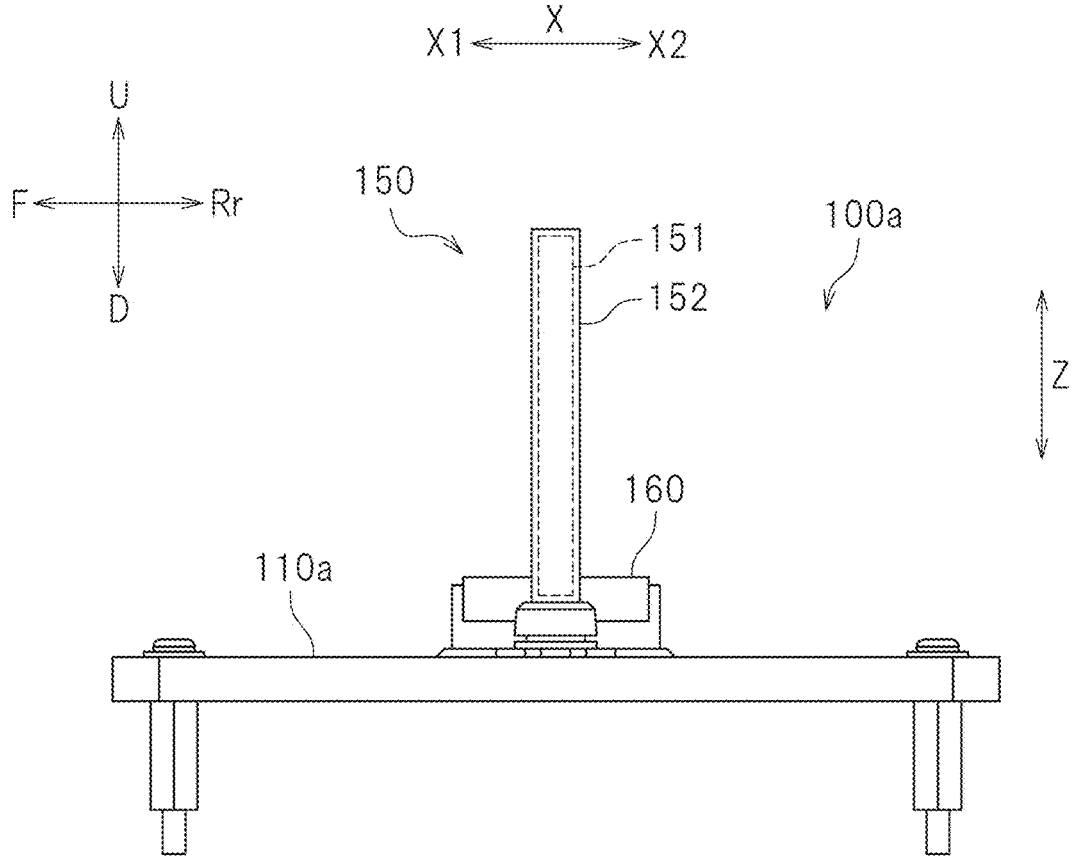
FIG. 9 is a side view of a cleaning unit according to a first variation of a preferred embodiment of the present invention.

A first variation of a preferred embodiment of the present invention involves using a cleaning unit 100*a* having a structure different from the structure described in the foregoing preferred embodiment. FIG. 9 is a side view of the cleaning unit 100*a* according to the first variation. As illustrated in FIG. 9, the cleaning unit 100*a* includes a wiper 150 defining and functioning as a cleaner. A base 110*a* includes a vise 160 gripping the wiper 150.

The wiper 150 has a plate shape. The wiper 150 extends in the main scanning direction Y (i.e., a direction perpendicular to the plane of FIG. 9). The wiper 150 is provided substantially vertically. In this variation, the wiper 150 includes a close contact structure 151 and an absorber 152. The close contact structure 151 is provided in order to bring the wiper 150 into close contact with the ink heads 40A to 40D. The close contact structure 151 includes a flexible material (e.g., a polyurethane foam).

The absorber 152 has a sheet shape. The absorber 152 is placed over the close contact structure 151. A small amount of cleaning liquid is applied to the absorber 152 at the time of cleaning of the ink heads 40A to 40D. The vise 160 grips the wiper 150 (the close contact structure 151 and the absorber 152). The wiper 150, however, is not limited to this structure. In one example, the wiper 150 may only wipe off ink, that is, the wiper 150 does not necessarily have to absorb ink. In such a case, the wiper 150 may include only a flexible material (e.g., a polyurethane foam).

A second variation of a preferred embodiment of the present invention involves carrying out cleaning in directions different from those described in the foregoing preferred embodiment. A cleaner according to this variation extends in a direction different from the direction described in the foregoing preferred embodiment.

Figure 10:
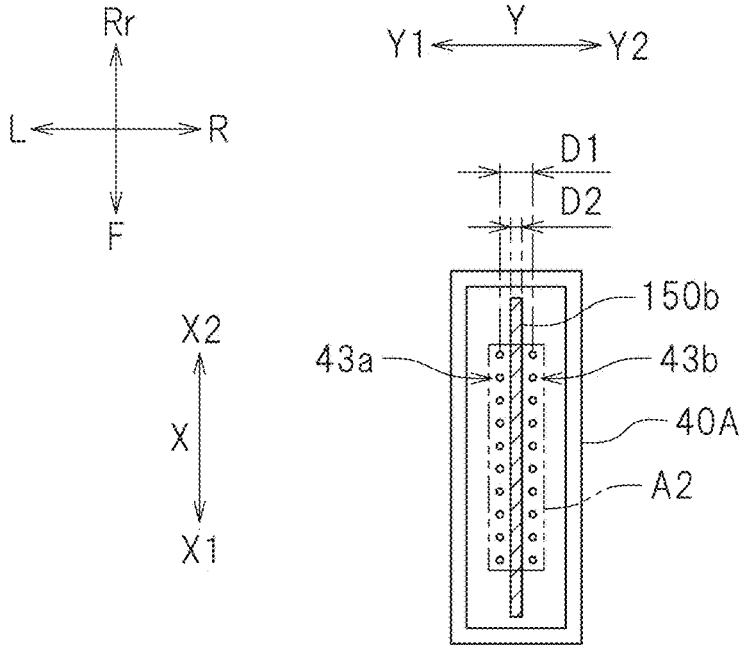
FIG. 10 is a plan view of a first ink head and a cleaning unit according to a second variation of a preferred embodiment of the present invention.

FIG. 10 is a plan view of a first ink head 40A and a cleaner 150*b* according to the second variation. A cleaning unit according to this variation includes the cleaner 150*b* implemented as a wiper. In this variation, the cleaner 150*b* extends in the sub-scanning direction X. A first nozzle row 43*a* and a second nozzle row 43*b* extend in the sub-scanning direction X. In the present variation, however, the direction of movement to clean is set to be a first main scanning direction Y1 and a second main scanning direction Y2. The first nozzle row 43*a* and the second nozzle row 43*b* extend in a direction perpendicular to the direction of movement to clean. The first nozzle row 43*a* and the second nozzle row 43*b* are provided side by side in the direction of movement to clean.

As illustrated in FIG. 10, a width D2 of the cleaner 150*b* in the main scanning direction Y is shorter than an interval D1 between the first nozzle row 43*a* and the second nozzle row 43*b* in the main scanning direction Y. As illustrated in FIG. 10, the cleaner 150*b* is thus placeable between the first nozzle row 43*a* and the second nozzle row 43*b* in the plan view.

This variation involves cleaning the first ink head 40A in cleaning directions different from those in the first to fifth steps S10 to S50 according to the foregoing preferred embodiment. In a first step according to this variation, a first controller 91*a* of a cleaning controller 91 moves the cleaner 150*b* into contact with a portion of the nozzle surface 42 between the first nozzle row 43*a* and the second nozzle row 43*b*. In a second step, the cleaning unit is moved in the second main scanning direction Y2 from this location. The second nozzle row 43*b* is thus cleaned in the second step.

In a third step, the cleaning controller 91 moves the cleaner 150*b* away from the nozzle surface 42. In a fourth step, a fourth controller 91*d* of the cleaning controller 91 moves the cleaner 150*b* into contact with a portion of the nozzle surface 42 between the first nozzle row 43*a* and the second nozzle row 43*b* again. In a fifth step, the cleaning unit is moved in the first main scanning direction Y1 from this location. The first nozzle row 43*a* is thus cleaned in the fifth step.

Similarly to the foregoing preferred embodiment, this cleaning method involves moving the cleaner 150*b* from the center of the nozzle forming region A2 to a region outside the nozzle forming region A2. Thus, a fluid, for example, ink, adhering to the region outside the nozzle forming region A2 will not be brought into the nozzle forming region A2. Because the direction of extension of the nozzle rows 43*a* and 43*b* is perpendicular to the cleaning directions, this cleaning method will not cause ink to move from one nozzle 41 to another nozzle 41. Accordingly, this variation is able to provide higher quality cleaning.

Figure 11:
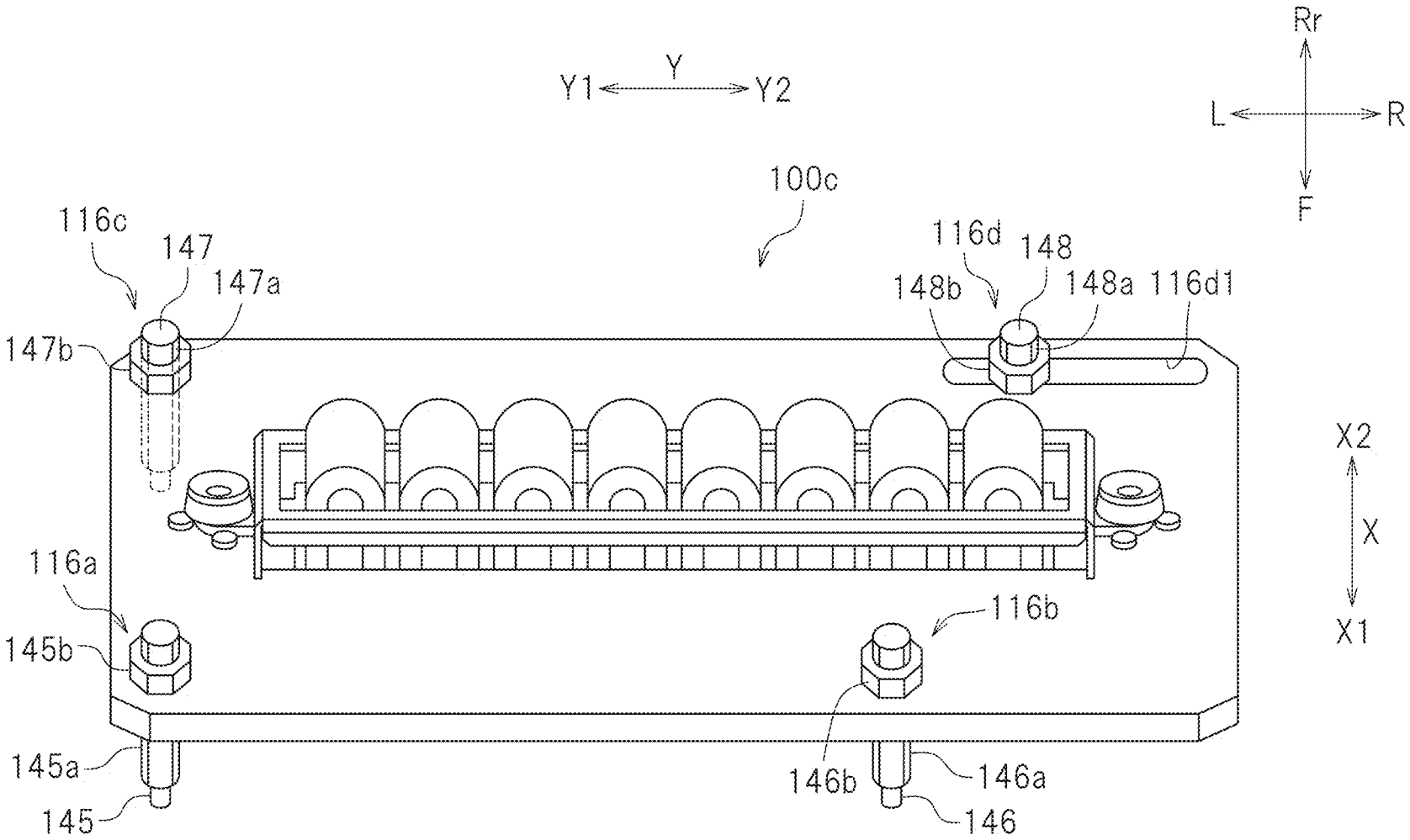
FIG. 11 is a perspective view of a cleaning unit according to a third variation of a preferred embodiment of the present invention.

In a third variation a preferred embodiment of the present invention, features to change leg lengths and features to change a fourth leg position are different from those described in the foregoing preferred embodiment. FIG. 11 is a perspective view of a cleaning unit 100*c* according to the third variation. As illustrated in FIG. 11, a base according to this variation includes leg fitting portions, i.e., first to fourth fitting portions 116*a* to 116*d*.

The first to third fitting portions 116*a* to 116*c* according to this variation each include a threaded hole. Each threaded hole passes through the base in the up-down direction Z. First to third legs 145 to 147 respectively correspond to the first to third fitting portions 116*a* to 116*c*. The first to third legs 145 to 147 respectively include bolts 145*a* to 147*a*. The bolts 145*a* to 147*a* are respectively fitted into the threaded holes of the first to third fitting portions 116*a* to 116*c*. Nuts are each fitted to a corresponding one of the bolts 145*a* to 147*a*. For example, a nut 145*b* is fitted to the bolt 145*a* of the first leg 145. In this variation, the nut 145*b* is provided on the upper side of the base. The length of protrusion of the first leg 145 from the lower surface of the base is changeable by rotating the first leg 145 fitted into the threaded hole of the first fitting portion 116*a*. Once the length of protrusion is decided, the nut 145*b* is tightened. The first leg 145 is thus secured to the base. Similar features and structures apply to the second leg 146 and the third leg 147.

The fourth fitting portion 116*d* includes a long hole 116*d*1. The long hole 116*d*1 passes through the base in the up-down direction Z. In this variation, the long hole 116*d*1 extends in the main scanning direction Y. The planar shape of the long hole 116*d*1, however, is not limited to any particular shape. The long hole 116*d*1 may extend in the sub-scanning direction X. The long hole 116*d*1 may bend at a location somewhere along its length to extend in both of the main scanning direction Y and the sub-scanning direction X. Alternatively, the fourth fitting portion 116*d* may be provided with more than one long hole 116*d*1. A fourth leg 148 includes a bolt 148*a*. The bolt 148*a* passes through the long hole 116*d*1. An upper nut 148*b* and a lower nut (not illustrated) are fitted to the bolt 148*a*. The upper nut 148*b* is provided on the upper side of the base. The lower nut is provided on the lower side of the base. The position of the fourth leg 148 on the base is changeable by moving the fourth leg 148 horizontally along the long hole 116*d*1. The length of protrusion of the fourth leg 148 from the lower surface of the base is changeable by shifting the positions of the upper nut 148*b* and the lower nut. Once the length of protrusion is decided, the upper nut 148*b* and the lower nut are tightened together. The fourth leg 148 is thus secured to the base.

Also in this variation, the leg lengths of the cleaning unit and the position of at least one leg are adjustable. This variation is also able to provide, in particular, minute adjustment of the leg lengths and the position of at least one leg.

Figure 12A:
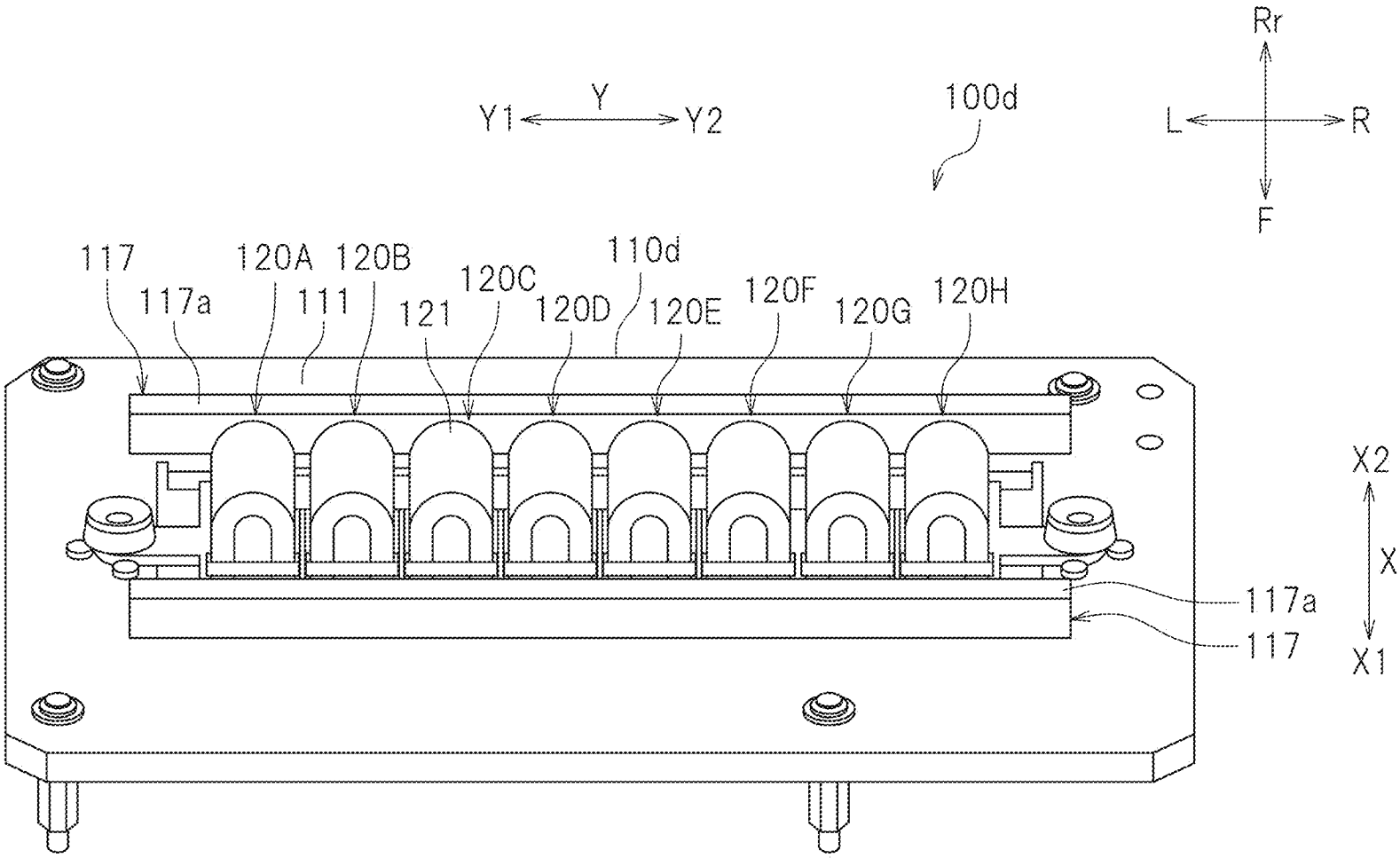
FIG. 12A is a perspective view of a cleaning unit according to a fourth variation of a preferred embodiment of the present invention, with a sheet retainer not fitted to a base.
Figure 12B:
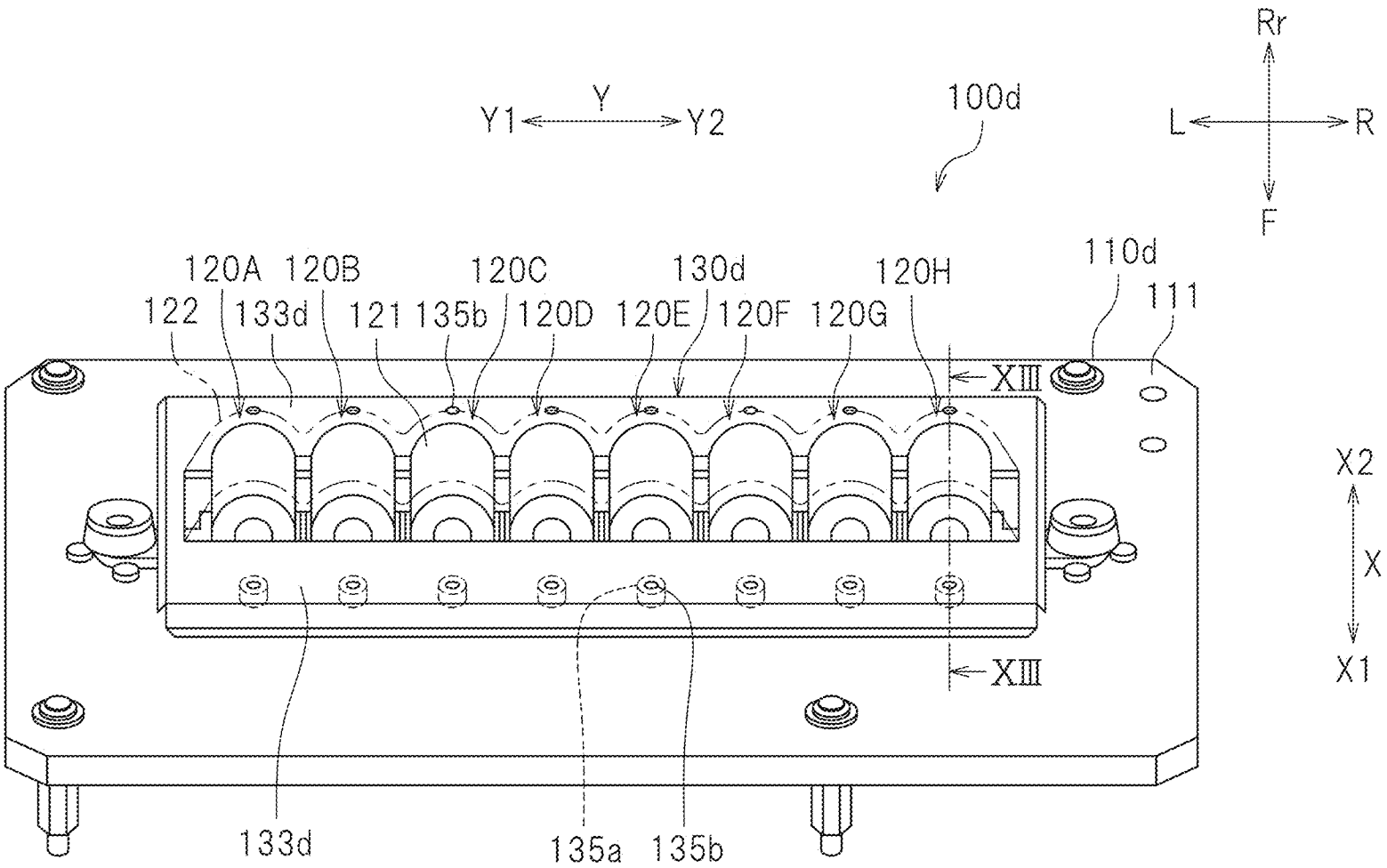
FIG. 12B is a perspective view of the cleaning unit according to the fourth variation of a preferred embodiment of the present invention, with the sheet retainer fitted to the base.

In a fourth variation of a preferred embodiment of the present invention, features and structures to retain an absorber differ from the features and structures described in the foregoing preferred embodiment. Specifically, a sheet retainer and a base are partially different in structure from those described in the foregoing preferred embodiment. FIGS. 12A and 12B are perspective views of a cleaning unit 100*d* according to this variation. FIG. 12A illustrates the cleaning unit 100*d*, with a sheet retainer 130*d* not fitted to a base 110*d*. FIG. 12B illustrates the cleaning unit 100*d*, with the sheet retainer 130*d* fitted to the base 110*d*.

As illustrated in FIG. 12A, the base 110*d* according to this variation includes two receivers 117. One of the two receivers 117 is located in front of cleaners 120A to 120H, and the other one of the two receivers 117 is located behind the cleaners 120A to 120H. The receivers 117 protrude above an upper surface 111 of the base 110*d*. The receivers 117 extend in the main scanning direction Y. The receivers 117 each include a flat upper surface 117*a*.

Figure 13:
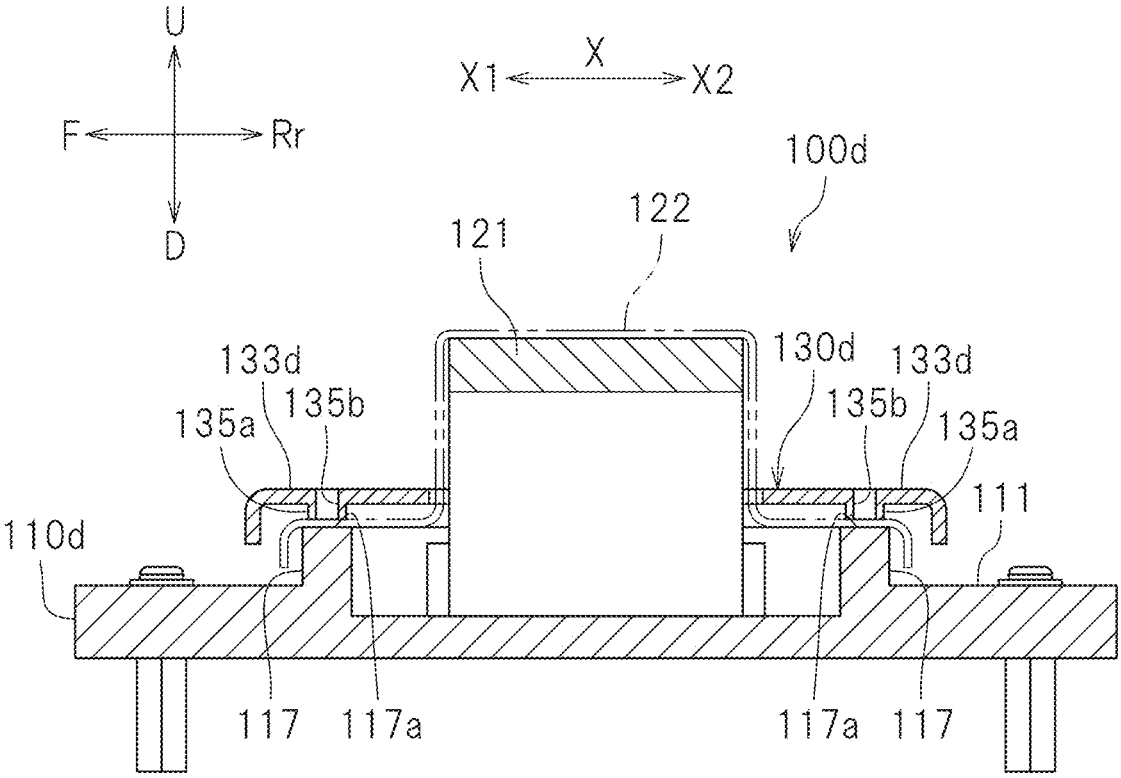
FIG. 13 is a vertical cross-sectional view of the cleaning unit according to the fourth variation of a preferred embodiment of the present invention.

FIG. 13 is a vertical cross-sectional view of the cleaning unit 100*d*. FIG. 13 is a cross-sectional view taken along the line XIII-XIII in FIG. 12B. As illustrated in FIG. 13, the sheet retainer 130*d* according to this variation includes sheet holders 133*d* in abutment with an absorber 122. Each sheet holder 133*d* includes a plurality of protrusions 135*a* and a plurality of through holes 135*b*. The protrusions 135*a* are portions of the sheet holders 133*d* in abutment with the absorber 122.

The sheet holders 133*d* each have a flat plate shape. The protrusions 135*a* protrude downward from the lower surfaces of the sheet holders 133*d*. With the sheet retainer 130*d* fitted to the base 110*d*, the receivers 117 of the base 110*d* are located under the sheet holders 133*d* and face the sheet holders 133*d*. In this state, the protrusions 135*a* thus protrude toward the receivers 117. The protrusions 135*a* are in abutment with the absorber 122 in retaining the absorber 122. The protrusions 135*a* are also in abutment with the upper surfaces 117*a* of the receivers 117 through the absorber 122. The absorber 122 is retained by being sandwiched between the protrusions 135*a* and the receivers 117.

The through holes 135*b* pass through the protrusions 135*a* in the up-down direction. The through holes 135*b* pass through the sheet holders 133*d* from surfaces of the sheet holders 133*d* (i.e., upper surfaces of the sheet holders 133*d* in this variation), which are opposite to surfaces of the sheet holders 133*d* provided with the protrusions 135*a*, to ends of the protrusions 135*a*. In this variation, the protrusions 135*a* are created by burring, and the protrusions 135*a* extend outward from the through holes 135*b* and protrude downward. In one example, the protrusions 135*a* are created by shaping punching burrs produced during machining of the through holes 135*b*. In the plan view, the through holes 135*b* substantially concentric with the protrusions 135*a* are bored in substantially central portions of the protrusions 135*a*, and the protrusions 135*a* each have a ring shape.

As illustrated FIG. 12B, the sheet holders 133*d* are each provided with the protrusions 135*a* provided in the main scanning direction Y. One of the sheet holders 133*d* is located in front of the cleaners 120A to 120H and faces a corresponding one of the two receivers 117. The other sheet holder 133*d* is located behind the cleaners 120A to 120H and faces a corresponding one of the two receivers 117. One of the rows of the protrusions 135*a* is located in front of the cleaners 120A to 120H and extends in the main scanning direction Y. The other one of the rows of the protrusions 135*a* is located behind the cleaners 120A to 120H and extends in the main scanning direction Y. The front row of the protrusions 135*a* and the rear row of the protrusions 135*a* are symmetric with respect to the cleaners 120A to 120H.

For example, the front sheet holder 133*d* is provided with the protrusions 135*a* whose number is equal to the number of cleaners 120A to 120H, and thus that the number of protrusions 135*a* of the front sheet holder 133*d* is eight in this variation. The protrusions 135*a* each correspond to one of the cleaners 120A to 120H. In this variation, each of the protrusions 135*a* of the front sheet holder 133*d* is located in front of a corresponding one of the cleaners. The rear sheet holder 133*d* has a similar structure. Each of the protrusions 135*a* of the rear sheet holder 133*d* is thus located behind a corresponding one of the cleaners.

The protrusions 135*a* more firmly secure the absorber 122 to the base 110*d*. The presence of the protrusions 135*a* reduces the area of contact of each sheet holder 133*d* with the absorber 122. A pressure to press the absorber 122 downward is thus increased to more firmly secure the absorber 122 to the base 110*d*. Accordingly, the absorber 122 is unlikely to deviate from close contact structures 121 during cleaning of ink heads 40A to 40D by the cleaning unit 100*d*, resulting in enhancement of cleaning effect.

In this variation, the protrusions 135*a* are provided with the through holes 135*b* to further reduce the area of contact of each sheet holder 133*d* with the absorber 122. Accordingly, deviation of the absorber 122 is more unlikely to occur, resulting in further enhancement of cleaning effect.

The protrusions 135*a* correspond to the cleaners 120A to 120H. In this variation, each front protrusion 135*a* and each rear protrusion 135*a* correspond to one of the cleaners. Accordingly, the absorber 122 would be unlikely to deviate from the close contact structures 121 if the number of close contact structures 121 is increased.

The through holes 135*b* also define and function as marks when the user visually checks the positions of the cleaners 120A to 120H. With the absorber 122 fitted to the close contact structures 121, the cleaners 120A to 120H are hidden by the absorber 122 and thus invisible. In this variation, however, the through holes 135*b* are located in front of and behind the cleaners 120A to 120H. Accordingly, the user is able to recognize the positions of the cleaners 120A to 120H in the main scanning direction Y.

In the present variation, the through holes 135*b* are bored in the sheet holders 133*d* each having a flat plate shape, and resulting punching burrs define the protrusions 135*a*. Accordingly, regions that define and function as both marks and protrusions are able to be provided.

Although the marks for visual checking by the user are the through holes 135*b* in this variation, the marks may be any other elements. The marks for visual checking by the user may be, for example, recesses that do not pass through the sheet holders 133*d*. In this case, the protrusions may be projections defined by the recesses protruding downward. The protrusions are not limited to any particular structure.

The number of protrusions 135*a* is not limited to any particular number. The locations of the protrusions 135*a* are not limited to any particular locations. In one example, each of the protrusions 135*a* may be provided for more than one cleaner. The protrusions 135*a* do not necessarily have be located in front of and behind the cleaners 120A to 120H. The protrusions 135*a* may be located either in front of or behind the cleaners 120A to 120H. Alternatively, the protrusions 135*a* may be located rightward and leftward of the cleaners 120A to 120H. The number of protrusions 135*a* is not limited to any particular number. The locations of the protrusions 135*a* are not limited to any particular locations.

Figure 14:
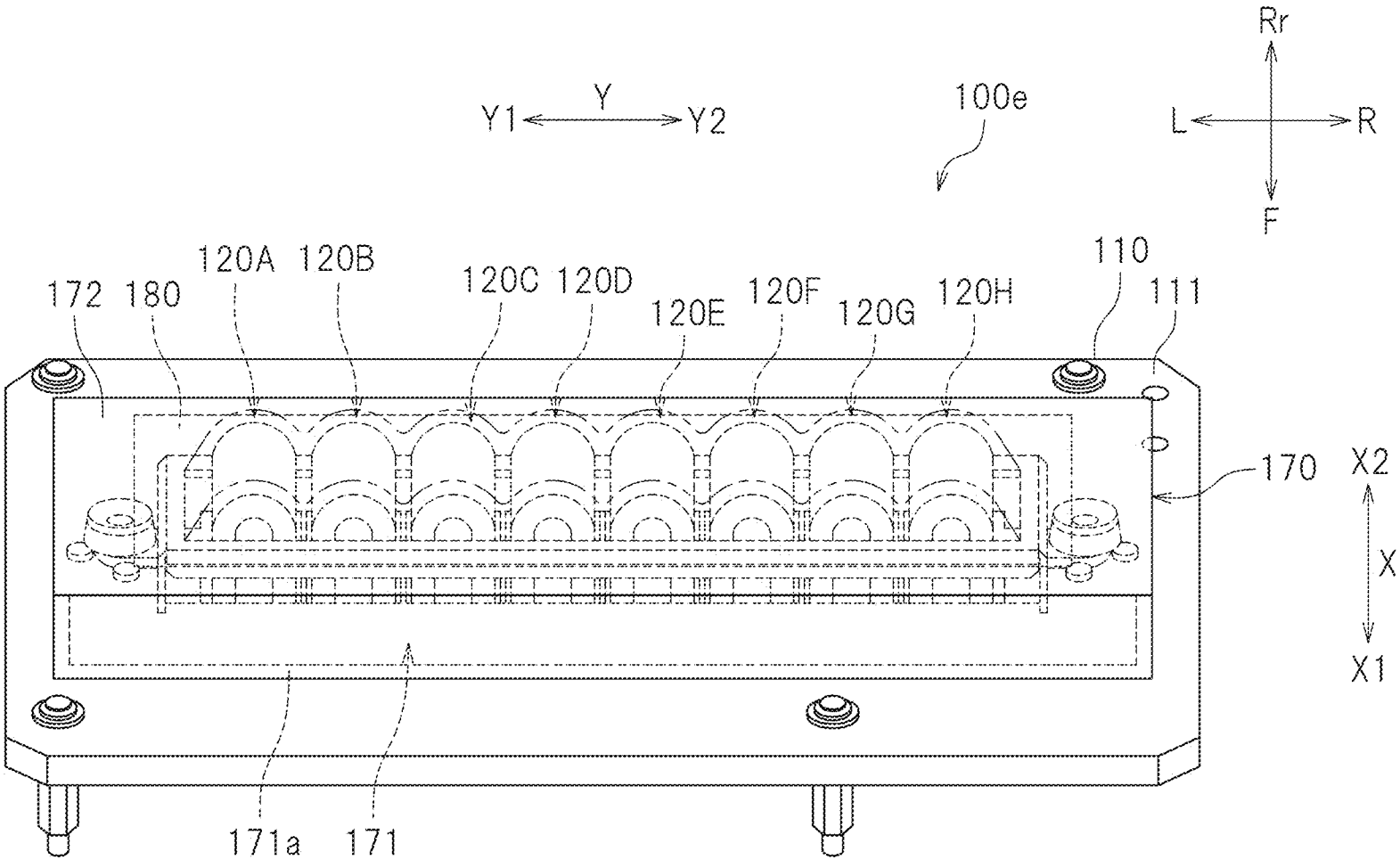
FIG. 14 is a perspective view of a cleaning unit according to a fifth variation of a preferred embodiment of the present invention, with a cover attached thereto.
Figure 15:
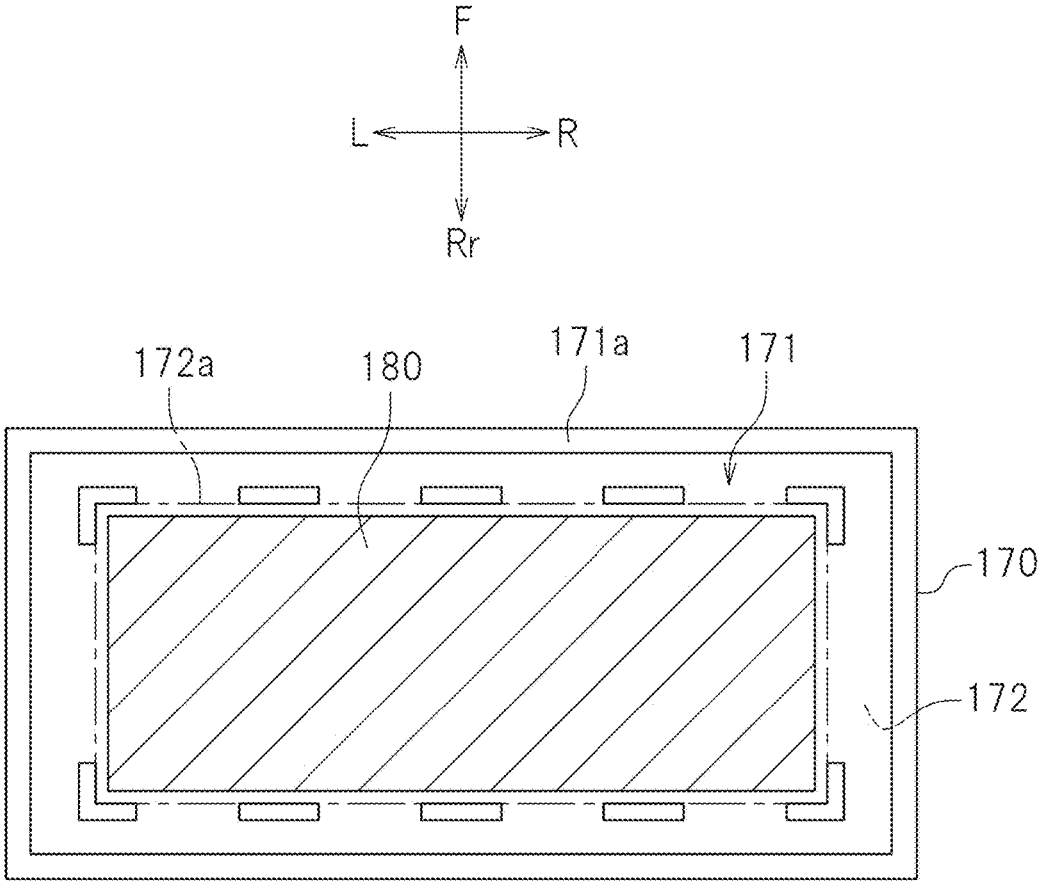
FIG. 15 is a plan view of the cover viewed from below.

In a fifth variation a preferred embodiment of the present invention, a cleaning unit includes a cover attached to the cleaning unit during non-use to cover the cleaners. FIG. 14 is a perspective view of a cleaning unit 100*e*, with its cover 170 attached thereto. FIG. 15 is a plan view of the cover 170 viewed from below.

As illustrated in FIG. 14, the cover 170 has a cuboidal box shape. As illustrated in FIG. 15, the cover 170 includes an opening 171 through which cleaners 120A to 120H pass upon attachment of the cover 170 to the cleaning unit 100*e*. The cover 170 is attachable to and detachable from a base 110. In this variation, the opening 171 extends across an entire lower portion of the cover 170. The cover 170 is a bottomless box structure including a top plate 172. The cover 170 includes a material impervious to light. In this variation, the cover 170 includes an opaque resin.

The cover 170 is attached to the base 110 and covers the cleaners 120A to 120H. Upon attachment of the cover 170 to the base 110, the cleaners 120A to 120H are housed in the cover 170. When the cover 170 is attached to the base 110, the cleaners 120A to 120H pass through the opening 171 and are thus housed in the cover 170. With the cover 170 attached to the base 110, an edge 171*a* of the opening 171 is placed on an upper surface 111 of the base 110. In this state, the edge 171*a* of the opening 171 surrounds the cleaners 120A to 120H from four sides.

The cover 170 is internally provided with an ink absorber 180. As illustrated in FIG. 15, the ink absorber 180 is affixed to the top plate 172 facing the opening 171. The ink absorber 180 faces the opening 171 of the cover 170. The ink absorber 180 has a flat plate shape. The ink absorber 180 is affixed to an ink absorber mounting position 172*a* located on a central portion of the top plate 172. The ink absorber mounting position 172*a* is set at a location facing the cleaners 120A to 120H upon attachment of the cover 170 to the base 110. The ink absorber 180 thus faces the cleaners 120A to 120H upon attachment of the cover 170 to the base 110.

The ink absorber 180 includes, for example, an ink-absorbing material (e.g., a sponge). A material having ink solvent resistance is preferably included for the ink absorber 180. In the plan view, the ink absorber 180 is larger than the cleaners 120A to 120H. The length of the ink absorber 180 in the sub-scanning direction X is longer than the length of the cleaners 120A to 120H in the sub-scanning direction X. The length of the ink absorber 180 in the main scanning direction Y is longer than the length measured from the left end of the first cleaner 120A to the right end of the eighth cleaner 120H. In the plan view, the cleaners 120A to 120H are located inward of the ink absorber 180.

The ink absorber 180 is provided to come into contact with the cleaners 120A to 120H upon attachment of the cover 170 to the base 110. When the cover 170 is attached to the base 110, the height of the lower surface of the ink absorber 180 is lower than the height of the upper ends of the cleaners 120A to 120H. The ink absorber 180 thus comes into contact with the cleaners 120A to 120H upon attachment of the cover 170 to the base 110. When ink is adhering to the cleaners 120A to 120H, the ink will be absorbed into the ink absorber 180.

The cover 170 is a component to be attached to the base 110 when the cleaning unit 100*e* is not in use. When the cleaning unit 100*e* is in use, the cover 170 is removed from the base 110. Before putting the cover 170 back on the base 110, for example, an absorber 122 that has been used is removed from the cleaners 120A to 120H by the user. Upon this removal, ink that has oozed from the absorber 122 may be adhering to close contact structures 121. Upon attachment of the cover 170 to the base 110 in this state, the ink adhering to the close contact structures 121 will be absorbed into the ink absorber 180. Thus, the close contact structures 121 will be in a clean state. Accordingly, when the absorber 122 to be used next is attached to the close contact structures 121, the absorber 122 is prevented from being contaminated with the ink.

The cover 170 prevents ink remaining on the cleaning unit 100*e* from solidifying when the cleaning unit 100*e* is not in use. Although most of the ink is believed to be removed by the ink absorber 180, the ink may still be adhering to the cleaning unit 100*e*. The cover 170 prevents solidification of the ink that has not been removed. In this variation, the cover 170 blocks light to prevent solidification of photo-curable ink. The cover 170 includes a material impervious to light. The cover 170 is thus able to prevent or reduce ink solidification when the ink is photo-curable ink. Because the cover 170 covers the cleaners 120A to 120H, the cover 170 would be able to prevent or reduce ink solidification by limiting drying of the ink if the ink is photo-curable ink. The cover 170 also prevents spreading of an offensive smell, which is emitted from the ink, by covering the cleaners 120A to 120H.

In this variation, the cover 170 has a cuboidal box shape. The cover 170, however, may have any other shape. In this variation, the cover 170 is attached to the base 110 by being placed on the base 110 and is detached from the base 110 by being lifted therefrom. Other structures may be provided, or other operations performed, to attach and detach the cover 170 from the base 110.

In a sixth variation a preferred embodiment of the present invention, a cleaning unit includes a sheet retainer openable and closable by being rotated around rotation shafts. The sixth variation may be combined with any of the preferred embodiments described thus far. The following description discusses the sixth variation combined with the fourth variation.

Figure 16:
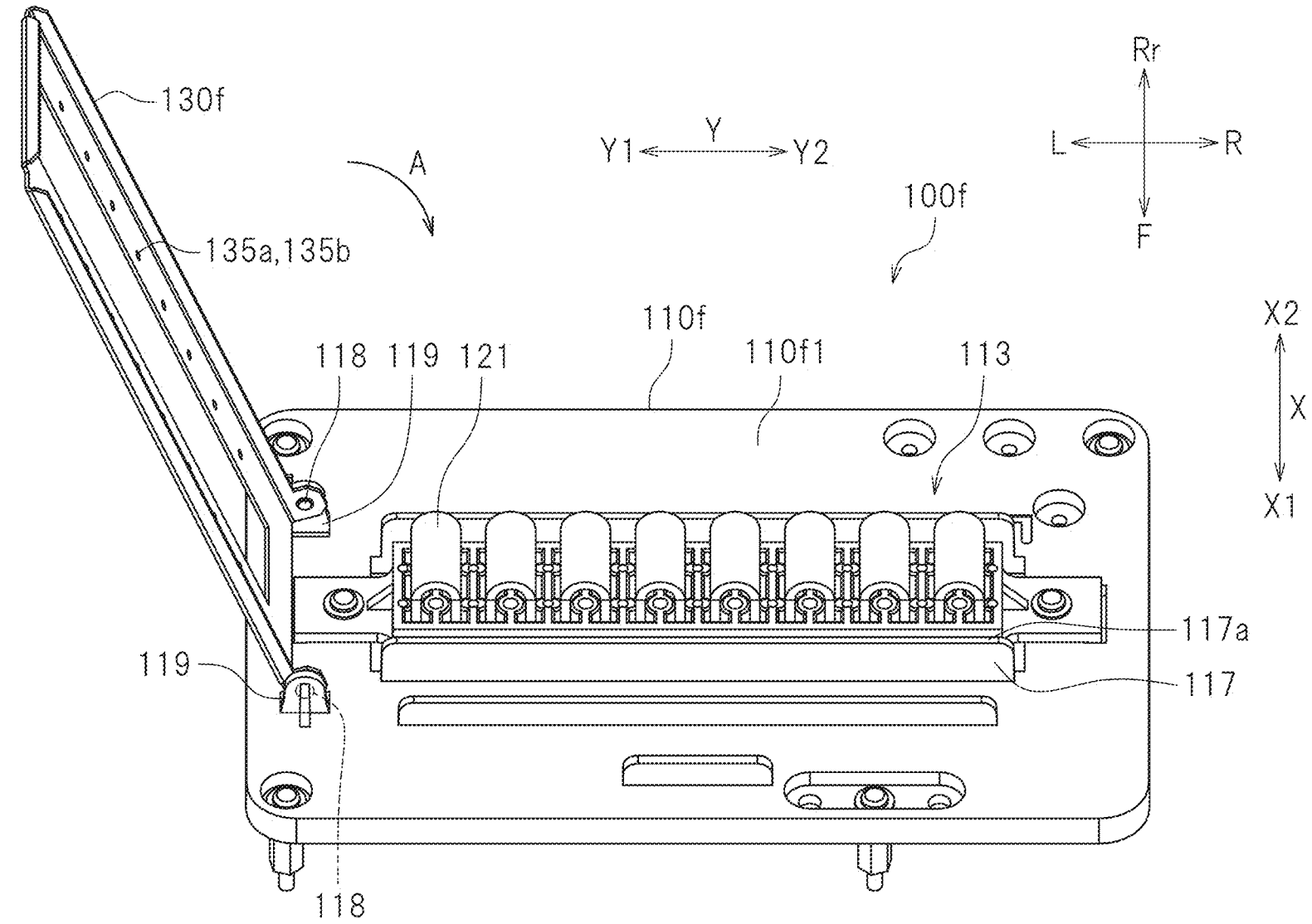
FIG. 16 is a perspective view of a cleaning unit according to a sixth variation of a preferred embodiment of the present invention.

FIG. 16 is a perspective view of a cleaning unit 100*f* according to the sixth variation. As illustrated in FIG. 16, the cleaning unit 100*f* according to this variation includes a sheet retainer 130*f* and a pair of rotation shafts 118 around which the sheet retainer 130*f* is rotated. FIG. 16 illustrates the cleaning unit 100*f*, with the sheet retainer 130*f* opened. The sheet retainer 130*f* may be closed by being rotated in a direction A from the state illustrated in FIG. 16.

The rotation shafts 118 are provided in a pair of rotation shaft retainers 119 extending upward from an upper surface 110*f*1 of a base 110*f*. The pair of rotation shaft retainers 119 is located adjacent to or in a vicinity of a longitudinal one side of a close contact structure retainer 113. In this variation, the pair of rotation shaft retainers 119 is located leftward of the close contact structure retainer 113. The pair of rotation shaft retainers 119 are in alignment with each other and face each other in the sub-scanning direction X.

The pair of rotation shaft retainers 119 retains the rotation shafts 118 extending horizontally in the sub-scanning direction X. In this variation, the rotation shafts 118 are provided as separate front and rear rotation shafts. Alternatively, this variation may involve providing a single rotation shaft 118.

The sheet retainer 130*f* is rotatably retained by the pair of rotation shafts 118. The pair of rotation shafts 118 retains the left end of the sheet retainer 130*f*. As used herein, the term "left end of the sheet retainer 130*f*" refers to the left end of the sheet retainer 130*f* in a closed state, and refers to the lower end of the sheet retainer 130*f* in an opened state illustrated in FIG. 16. The sheet retainer 130*f* is rotatable in the direction A around the pair of rotation shafts 118 facing each other.

In this variation, the sheet retainer 130*f* includes protrusions 135*a* and through holes 135*b* similar to those in the fourth variation. The base 110*f* includes receivers 117. In the state illustrated in FIG. 16, an absorber 122 is put over close contact structures 121, and then the sheet retainer 130*f* is closed by being rotated in the direction A. Accordingly, the absorber 122 is able to be set on the cleaning unit 100*f*. Upon closing of the sheet retainer 130*f*, the absorber 122 is sandwiched between the protrusions 135*a* and upper surfaces 117*a* of the receivers 117 and thus secured to the cleaning unit 100*f*. Thus, the absorber 122 is able to be secured to or released from the cleaning unit 100*f* just by rotating the sheet retainer 130*f*. Accordingly, this variation facilitates attachment and detachment of the absorber 122 to and from the cleaning unit 100*f*.

Preferred embodiments and several variations thereof have been described thus far. The foregoing preferred embodiments, however, are only illustrative, and the techniques disclosed herein may be used in various other implementations. For example, the cleaning unit according to the foregoing preferred embodiments are able to be fitted to the table on which the substrates are to be placed. The cleaning unit, however, is only required to be movable in position relative to the ink heads. The cleaning unit is not limited to a unit to be fitted to the table. The cleaning unit may be mounted on, for example, a conveyor outside the table. Alternatively, the ink heads may move three-dimensionally, and the cleaning unit may be immovable. Features and structures to change the positional relationship between the cleaning unit and the ink heads are not limited to any particular structure.

In the foregoing preferred embodiments, the cleaning unit includes a plurality of legs. The cleaning unit, however, does not necessarily have to include a plurality of legs. The cleaning unit may include, for example, a single leg that is L-shaped or C-shaped in the plan view. The leg(s) of the cleaning unit does/do not necessarily have to be provided on the lower surface of the base. The leg(s) may be attachable to, for example, the lateral surface(s) and/or upper surface of the base 110. The cleaning unit does not necessarily have to include the leg(s) to avoid the substrate positioning jig. The method to fit the cleaning unit to the table is not limited to any particular method. The cleaning unit may be fitted to the table, for example, through any other component.

The features and structures of the cleaners are also not limited. The cleaners described above are presented by way of preferred examples and do not impose any limitations on, for example, the shapes, materials, or locations of the cleaners. For example, the convex surface of each cleaner does not necessarily have to include a curved surface. Movements of the ink heads and the cleaning unit during cleaning are not limited to those described above.

Unless otherwise specified, the inkjet printer and the cleaning unit are not limited to any particular features, structure, or arrangement. The techniques disclosed herein may be used for, for example, roll-to-roll inkjet printers. The techniques disclosed herein may be used for, for example, an apparatus, such as a printer with a cutting head, a portion of which incorporates an inkjet printer.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An inkjet printer cleaning system comprising:
an inkjet printer; and
a cleaning unit; wherein
the inkjet printer includes:
an ink head; and
a table that faces the ink head and on which a substrate is to be placed; and
the cleaning unit includes:
an attachment attachable to and removable from the table;
a cleaner that faces the ink head upon attaching of the attachment to the table;
a conveyor to move the ink head and the table relative to each other; and
a cleaning controller to control the conveyor to bring the cleaner into contact with the ink head;
the table includes a placement surface on which the substrate is to be placed; and
the conveyor includes:
a first conveyor to move the table in a first direction parallel or substantially parallel to the placement surface;
a second conveyor to move the ink head in a second direction parallel or substantially parallel to the placement surface and perpendicular or substantially perpendicular to the first direction; and
a third conveyor to move the table in a third direction perpendicular or substantially perpendicular to the placement surface.

2. The inkjet printer cleaning system according to claim 1, wherein
the cleaner includes an absorber to absorb ink;
the cleaning unit includes a retainer retaining the absorber; and
the absorber is attachable to and detachable from the cleaning unit.

3. The inkjet printer cleaning system according to claim 1, wherein
the cleaning unit includes a base having a flat plate shape;
the cleaner is provided on a first surface of the base; and
the attachment includes a leg assembly provided on a second surface of the base and installed on the table of the inkjet printer.

4. The inkjet printer cleaning system according to claim 3, wherein
the leg assembly includes a plurality of legs; and
the plurality of legs are each changeable in length.

5. The inkjet printer cleaning system according to claim 4, wherein each of the plurality of legs includes one of a plurality of leg portions attachable to and detachable from the base and being different in length.

6. The inkjet printer cleaning system according to claim 3, wherein
the leg assembly includes a plurality of legs; and
at least one of the plurality of legs is shiftable in position on the base.

7. The inkjet printer cleaning system according to claim 6, wherein
the leg shiftable in position is attachable to and detachable from the base;
the base includes a plurality of fitting portions into which and from which the leg shiftable in position is attachable and removable; and
the fitting portions are larger in number than the leg shiftable in position.

8. The inkjet printer cleaning system according to claim 3, wherein
the leg assembly includes a plurality of legs;
the table includes a cleaning unit installation portion on which the cleaning unit is to be installed; and
the cleaning unit installation portion includes at least two fitting holes into which at least two of the plurality of legs are to be inserted.

9. The inkjet printer cleaning system according to claim 8, wherein
the at least two fitting holes are located outside a printing area of the table;
at least one of the plurality of legs is shiftable in position on the base; and
a shiftable range of the leg shiftable in position at least partially overlaps with the printing area of the table.

10. The inkjet printer cleaning system according to claim 1, wherein
the cleaner includes a convex surface; and
the convex surface of the cleaner includes a flexible ink-absorbing material.

11. The inkjet printer cleaning system according to claim 10, wherein the convex surface includes a curved surface.

12. The inkjet printer cleaning system according to claim 10, wherein the convex surface extends in a first direction and has a cross-sectional shape that remains unchanged in the first direction.

13. The inkjet printer cleaning system according to claim 10, wherein the cleaner includes:

a close contact structure provided with the convex surface including a flexible material; and an absorber including an ink-absorbing sheet material, the absorber being provided along an outer periphery of the convex surface of the close contact structure, the absorber being curved along the convex surface.

14. The inkjet printer cleaning system according to claim 13, wherein the convex surface extends in a first direction and has a cross-sectional shape that remains unchanged in the first direction;

the absorber is attachable to and detachable from the close contact structure, the absorber being longer in length than the close contact structure in the first direction;

the cleaning unit includes a sheet retainer pressing the absorber against the close contact structure; and the sheet retainer includes:

a sheet holder to press a portion of the absorber located outward of the close contact structure in the first direction; and a freeing portion to free a portion of the absorber located outward of the close contact structure in a second direction perpendicular or substantially perpendicular to the first direction.

15. The inkjet printer cleaning system according to claim 13, wherein the absorber is attachable to and detachable from the close contact structure;

the cleaning unit includes:

a sheet retainer including a sheet holder in abutment with the absorber; and a receiver facing the sheet holder;

the sheet holder includes a protrusion protruding toward the receiver, the protrusion being in abutment with the absorber; and the absorber is retained by being sandwiched between the protrusion and the receiver.

16. The inkjet printer cleaning system according to claim 15, wherein the sheet holder has a flat plate shape, the sheet holder including a first surface provided with the protrusion, a second surface opposite to the first surface, and a through hole passing through the sheet holder from the second surface to an end of the protrusion.

17. An inkjet printer cleaning system comprising:

an inkjet printer; and a cleaning unit; wherein the inkjet printer includes:

an ink head;

an additional ink head; and a table that faces the ink head and on which a substrate is to be placed;

the cleaning unit includes:

an attachment attachable to and removable from the table; and a cleaner that faces the ink head upon attaching of the attachment to the table;

the cleaner includes a convex surface;

the convex surface of the cleaner includes a flexible ink-absorbing material;

the ink head extends in a first direction;

the additional ink head extends in the first direction, the additional ink head being provided side by side with the ink head in a second direction perpendicular or substantially perpendicular to the first direction;

the cleaning unit includes a plurality of additional cleaners provided side by side with the cleaner in the second direction;

the ink head and the additional ink head are provided at a first pitch in the second direction; and the cleaner and the additional cleaners are provided at a second pitch in the second direction, the second pitch being half of the first pitch.

18. An inkjet printer cleaning system comprising:

an inkjet printer; and a cleaning unit; wherein the inkjet printer includes:

an ink head; and a table that faces the ink head and on which a substrate is to be placed;

the cleaning unit includes:

an attachment attachable to and removable from the table; and a cleaner that faces the ink head upon attaching of the attachment to the table;

the cleaner includes a convex surface;

the convex surface of the cleaner includes a flexible ink-absorbing material;

the cleaner includes:

a close contact structure provided with the convex surface including a flexible material; and an absorber including an ink-absorbing sheet material, the absorber being provided along an outer periphery of the convex surface of the close contact structure, the absorber being curved along the convex surface;

the convex surface of the close contact structure includes a bent flat plate material that bulges outward; and the cleaning unit includes a close contact structure retainer holding the flat plate material in a bent state with the flat plate material bulging outward.

* * * * *